US007607704B2

(12) United States Patent
Kondratuk

(10) Patent No.: US 7,607,704 B2
(45) **Date of Patent: *Oct. 27, 2009**

(54) PUSH-PULL LATCH BOLT MECHANISM

(75) Inventor: Michael W. Kondratuk, Cameron, WI (US)

(73) Assignee: Hardware Specialties, Inc., Spooner, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/043,212

(22) Filed: Jan. 26, 2005

(65) Prior Publication Data

US 2005/0151380 A1 Jul. 14, 2005

Related U.S. Application Data

(63) Continuation-in-part of application No. 10/352,323, filed on Jan. 29, 2003, now Pat. No. 6,926,315.

(51) Int. Cl.
*E05B 9/00* (2006.01)

(52) U.S. Cl. ..... 292/337; 292/1; 292/170

(58) Field of Classification Search ..... 292/165, 292/170, 169, 358, 169.16, 1, 337
See application file for complete search history.

(56) References Cited

U.S. PATENT DOCUMENTS

| | | | | | |
|---|---|---|---|---|---|
| 109,074 | A | * | 11/1870 | Stuart | 292/170 |
| 483,318 | A | | 9/1892 | Armstrong | |
| 935,004 | A | | 9/1909 | Farch | |
| 980,630 | A | * | 1/1911 | Granger | 292/170 |
| 1,173,007 | A | | 2/1916 | Leusley | |
| 1,197,201 | A | * | 9/1916 | Gruber | 292/164 |
| 1,205,249 | A | | 11/1916 | Newcome | |
| 1,257,998 | A | * | 3/1918 | Gruber | 292/170 |
| 1,375,287 | A | | 4/1921 | Gjukie | |
| 1,554,839 | A | | 9/1925 | Brown | |
| 1,645,234 | A | | 10/1927 | Deimer | |
| 1,733,442 | A | | 10/1929 | Bartholomew | |
| 2,036,154 | A | * | 3/1936 | Littledale | 292/170 |
| 2,124,099 | A | * | 7/1938 | Zagrezejewski | 292/170 |

(Continued)

OTHER PUBLICATIONS

Wright Products for Inside Latch Assemblies for Push Button and Thumb Lever Handles, 10-11.

*Primary Examiner*—Peter M Cuomo
*Assistant Examiner*—Kristina R Fulton
(74) *Attorney, Agent, or Firm*—Moss & Barnett

(57) ABSTRACT

The present invention relates to an improved spindle arrangement for a latch bolt mechanism for a hinged door, and in particular, to a latch bolt mechanism actuated by spring-loaded push-pull spindles. The latch bolt mechanism includes a bolt with an inclined surface, a housing, at least one push-pull spindle with an inclined surface, and a spring mounted on the spindle for biasing the spindle in an extended position. The bolt is slidably mounted within the housing for movement between an extended position (extended outward from the housing) and a retracted position (positioned within the housing). The spindle slidably extends through an opening in the housing and bolt, transversely aligned with respect to the line of travel of the bolt. As the spindle is pushed towards or pulled away from the housing, the inclined surface of the spindle engages the inclined surface of the bolt to actuate movement of the bolt between the extended and retracted positions.

34 Claims, 24 Drawing Sheets

U.S. PATENT DOCUMENTS

| | | | | | |
|---|---|---|---|---|---|
| 2,317,300 | A | | 4/1943 | Quinn | |
| 2,726,533 | A | | 12/1955 | Quinn | |
| 2,726,889 | A | * | 12/1955 | Lawson | 292/170 |
| 2,773,376 | A | | 12/1956 | Wartian | |
| 2,939,737 | A | * | 6/1960 | Nygren | 292/170 |
| 3,039,804 | A | | 6/1962 | Quinn | |
| 3,188,840 | A | | 6/1965 | Wartian | |
| 3,246,922 | A | | 4/1966 | Behrens | |
| 3,333,879 | A | | 8/1967 | Quinn | |
| 3,364,706 | A | | 1/1968 | Adam | |
| 3,677,591 | A | | 7/1972 | Waldo | |
| 3,843,177 | A | | 10/1974 | Waldo | |
| 4,007,954 | A | | 2/1977 | Erickson | |
| 4,632,439 | A | | 12/1986 | Miller | |
| 4,777,810 | A | * | 10/1988 | Webster | 70/150 |
| 4,864,835 | A | | 9/1989 | Wartian | |
| 4,902,054 | A | | 2/1990 | Swanson | |
| 5,026,101 | A | * | 6/1991 | Dotterweich et al. | 292/166 |
| 5,149,154 | A | | 9/1992 | Shannon | |
| 5,157,953 | A | * | 10/1992 | Hung | 70/224 |
| 5,678,870 | A | | 10/1997 | Pelletier | |
| 6,322,113 | B1 | | 11/2001 | Ayers et al. | |
| 6,352,289 | B1 | | 3/2002 | Fan | |
| 6,481,253 | B1 | | 11/2002 | Fan | |

* cited by examiner

PUSH-PULL LATCH BOLT MECHANISM

CROSS REFERENCE TO RELATED APPLICATION

This application is a continuation-in-part of U.S. patent application Ser. No. 10/352,323 filed on Jan. 29, 2003, now U.S. Pat. No. 6,926,315 which by this reference is incorporated as if fully set forth herein.

FIELD OF THE INVENTION

The present invention relates to a latch bolt mechanism for a hinged door, and in particular, a door latch mechanism actuated by push-pull spindles.

BACKGROUND OF THE INVENTION

Latch bolt mechanisms are utilized to retain a door in a closed position until it is intentionally opened. These latch bolt mechanisms frequently utilize cams to extend and retract the bolt. The cams may be actuated by rotary, lift, push, pull or trigger actuators. However, cam-operated latch bolt mechanisms can be complex, bulky and expensive to manufacture.

Push-pull-actuated latch bolts are known in the art for securing a door in a closed position until the latch bolt is moved to its retracted position by the pushing or pulling of a handle on one side of the door. As evidenced by U.S. Pat. No. 5,157,953 issued to Hung, such push-pull-type lock mechanisms can be quite complicated in their design and operation with many mating and interacting parts. They may, for instance, effectuate retraction of the latch bolt by means of a mating rib and groove combination on the latch bolt and spindle that require precise machining during manufacture, complicated installation processes, and result in increased wear during operation. See, e.g., U.S. Pat. No. 2,939,737 issued to Nygren, and U.S. Pat. No. 2,124,099 issued to Zagrzejewski.

Such a push or pull-actuated latch bolt also is often surface mounted to the interior side of a storm door, adjacent a main entrance door. As a result, the latch bolt mechanism hardware extends inwardly from the storm door and can interfere with the operation and/or closure of the main entrance door. These latches can also be somewhat unsightly. They may require a strike plate which would be visible even when the door is in a closed position. The strike plate may also interfere, or catch, a person who exits or enters through the doorway.

Some prior art latch bolt mechanisms have utilized a lock mechanism that slidably engages an inclined surface of the bolt so that when the latch bolt is locked in its extended position, and a force is applied inwardly on the bolt, the inclined surfaces of the bolt engage the inclined surface of the lock to cause the lock mechanism to slide to its unlocked position, thereby allowing retraction of the bolt. See U.S. Pat. No. 6,536,248 issued to Fan. However, this automatic unlocking feature defeats the purpose of a dead bolt lock, and makes the latch mechanism less secure.

Therefore, there is a need for a latch bolt mechanism that is: inexpensive to construct, compact in size with limited lateral projection to accommodate all door thickness applications and storm door use, simple in construction, and flexible in use with all types of actuators. There is also a need for a push-pull lock that functions as a true deadbolt lock and as a mortise push-pull latch bolt mechanism that is symmetrical for use on both right and left-handed doors without installer modification.

SUMMARY OF THE INVENTION

The present invention relates to a latch bolt mechanism for a hinged door that utilizes push-pull spindles rather than a cam to move the latch bolt. A latch bolt is slidably mounted within a housing. A spring or springs are mounted between the bolt and one end of the housing to bias the bolt in an extended position (extended outward from the housing), while permitting retraction of the bolt within the housing when an inward directed force is applied to the bolt. At least one spindle extends through the housing and bolt, transverse to the line of travel of the bolt. It may be desirable to accommodate two spindles, one from each side, in certain applications. The spindles have angled or inclined surfaces designed to engage corresponding inclined surfaces defined by the bolt. When an inward force ("push") is applied to a spindle, the inclined surface of the spindle engages the inclined surface of the bolt. The energy from movement of the spindle is then translated to the bolt, thereby causing the bolt to overcome the force of the spring bias and move from the extended position to a retracted position within the housing, so that the door may be freely opened. Upon release of the force on the spindle, the force of the spring causes the bolt and spindle to return to their original positions.

In an alternate embodiment, springs may be mounted on the spindles to assist with retraction of the spindles to their original standby position independently of the bolt movement. This allows a lighter spring to be utilized with respect to the bolt, which reduces manufacturing costs and improves bolt retraction upon normal door closure. The spindles may also be arranged so that an outward force ("pull") applied to the spindle will cause an inclined surface of the spindle to engage an inclined surface of the bolt to move the bolt to its retracted position, so that the door may be opened.

The push-pull latch bolt mechanism of the present invention can be used with various types of external actuators, including without limitation, trigger, rotary, push, pull and lift mechanisms.

A transverse lock mechanism is also provided by the invention which may be slidably mounted to the housing for movement in a direction transverse to that of the line of travel of the latch bolt. The bolt will slide freely back and forth past the lock until such time as the lock is pushed or transversely moved into engagement with a recess formed in the bolt, thereby securing the bolt in a locked position with respect to the housing and bolt. When such lock mechanisms are engaged, the bolt cannot be retracted by applying a force to the bolt directly or via the spindles; it can only be retracted upon movement of the lock back to its unlocked position. This arrangement creates a true deadbolt—namely, a bolt incapable of being unlocked unless the lock itself is intentionally released.

DETAILED DESCRIPTION OF THE PREFERRED EMBODIMENT

The present invention of a simple push-pull latch bolt mechanism will be described as it applies to its preferred embodiment. However, it is not intended that the present invention be limited to the described embodiment. Instead, it is intended that the invention cover all modifications, equivalents and alternatives which may be included within the spirit and scope of the invention.

Figure 1:
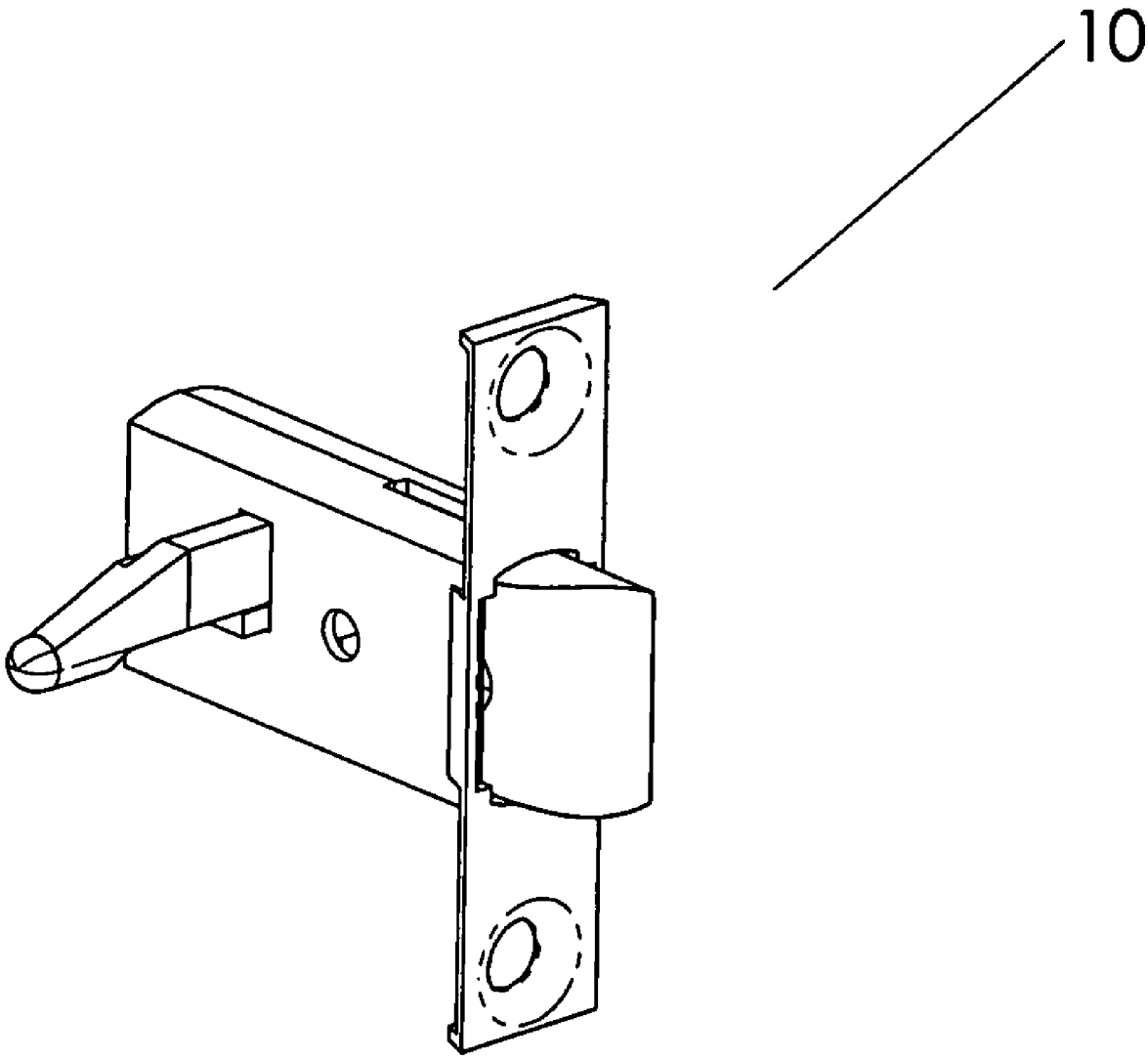
FIG. 1 is an isometric view of a preferred embodiment of a mortise version of the push-pull latch bolt mechanism.

Referring now to the drawings, wherein like reference numerals and letters indicate corresponding structure throughout the several views, and referring in particular to FIG. 1, there is shown a push-pull latch mechanism 10 according to the present invention. The latch bolt mechanism 10, as shown, is designed for installation in a door as a mortise lock. It may readily be appreciated that the embodiment can be modified to be surface mounted on the door as well.

Figure 2:
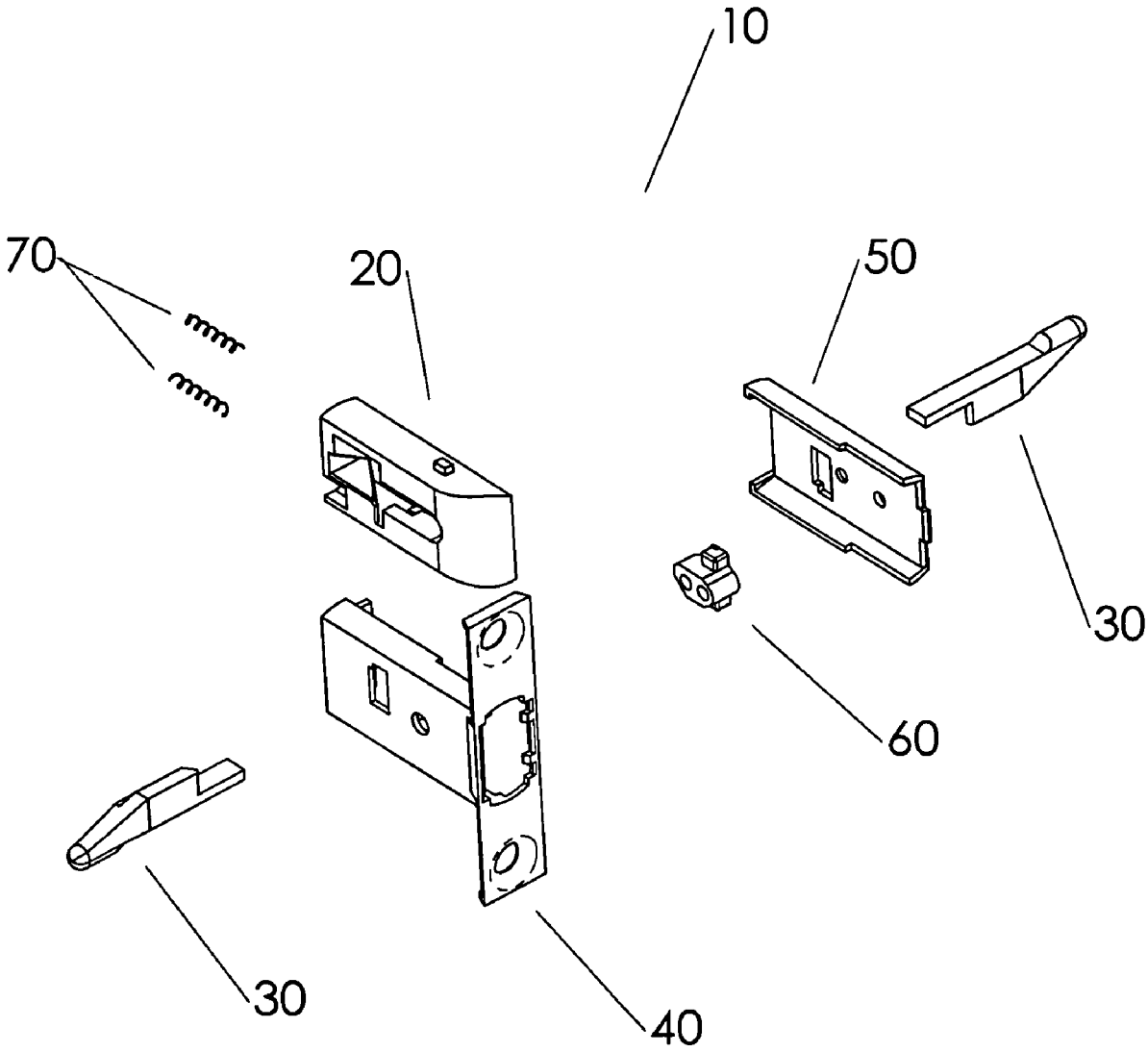
FIG. 2 is an exploded isometric view of the push-pull latch bolt mechanism.
Figure 12:
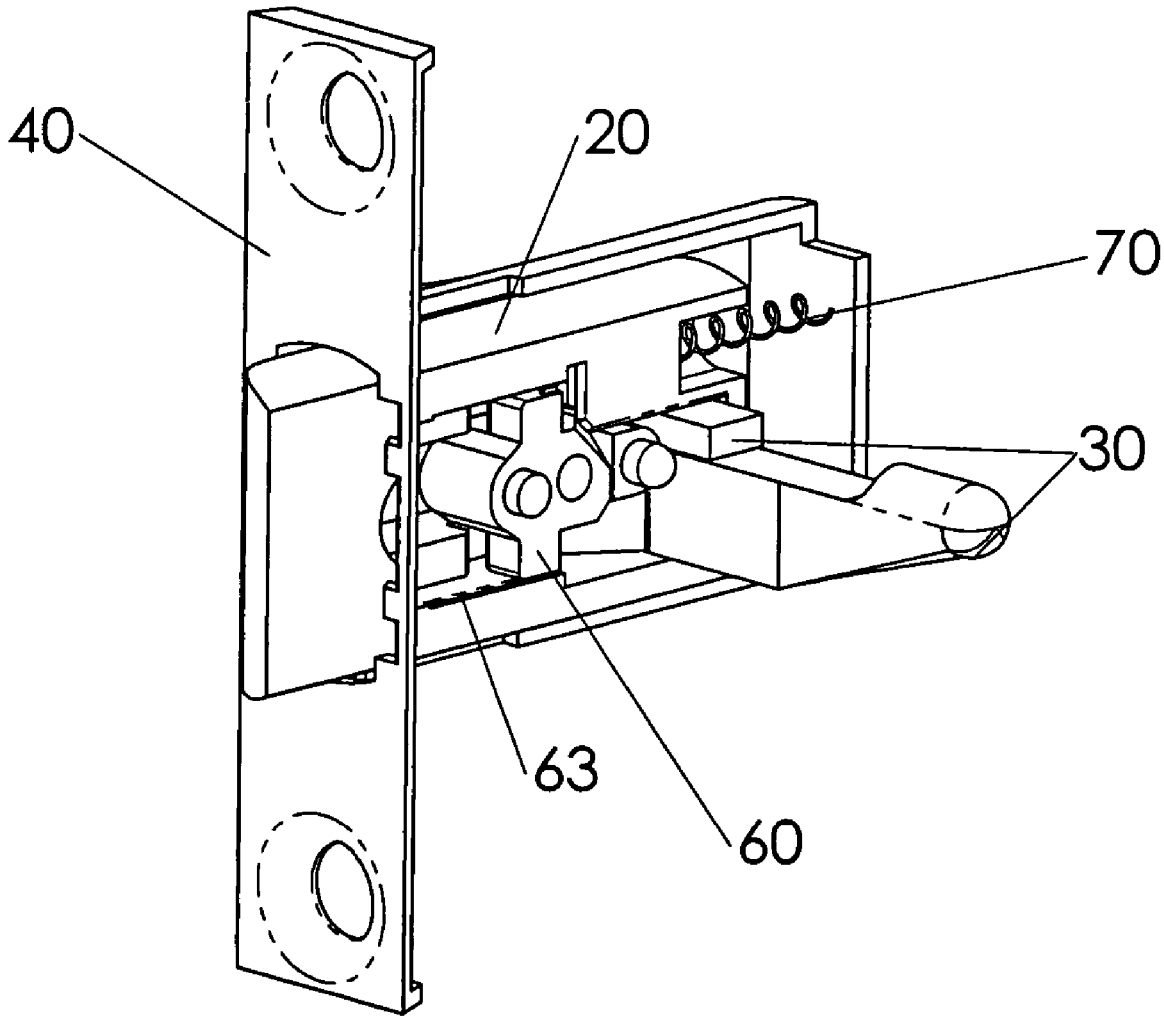
FIG. 12 is an isometric view of the latch bolt mechanism with the bolt in an extended position, with the housing cover removed.
Figure 16:
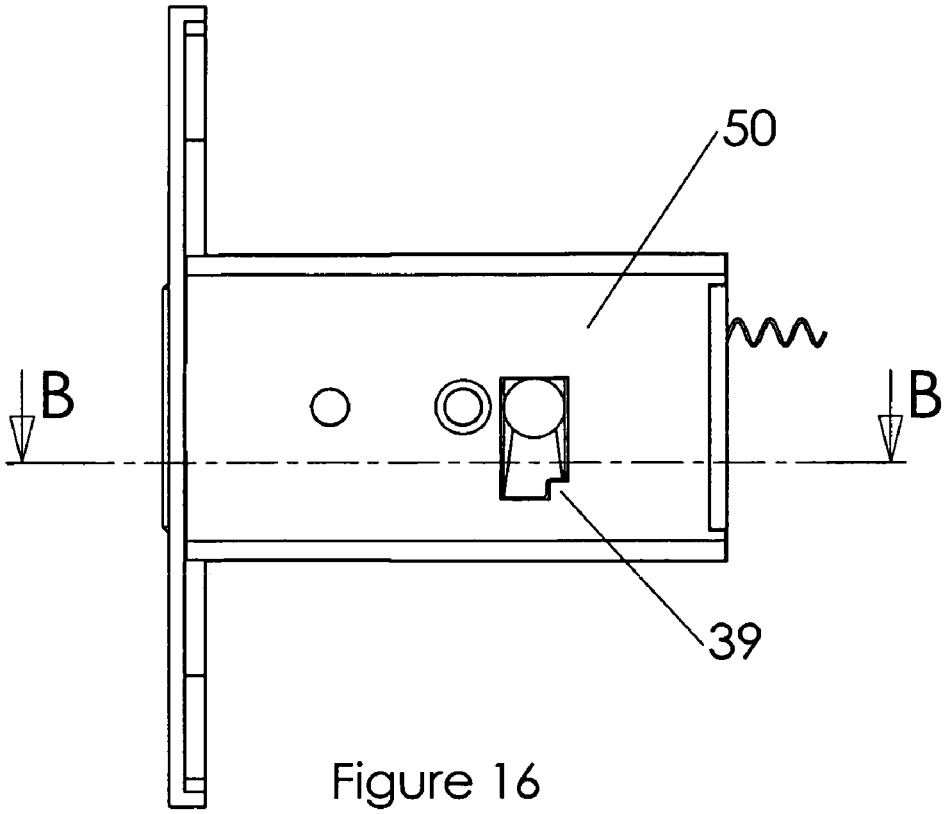
FIG. 16 is a (cover) side view of the latch bolt mechanism, with the bolt in its retracted position and the spindle engaging the bolt.
Figure 17:
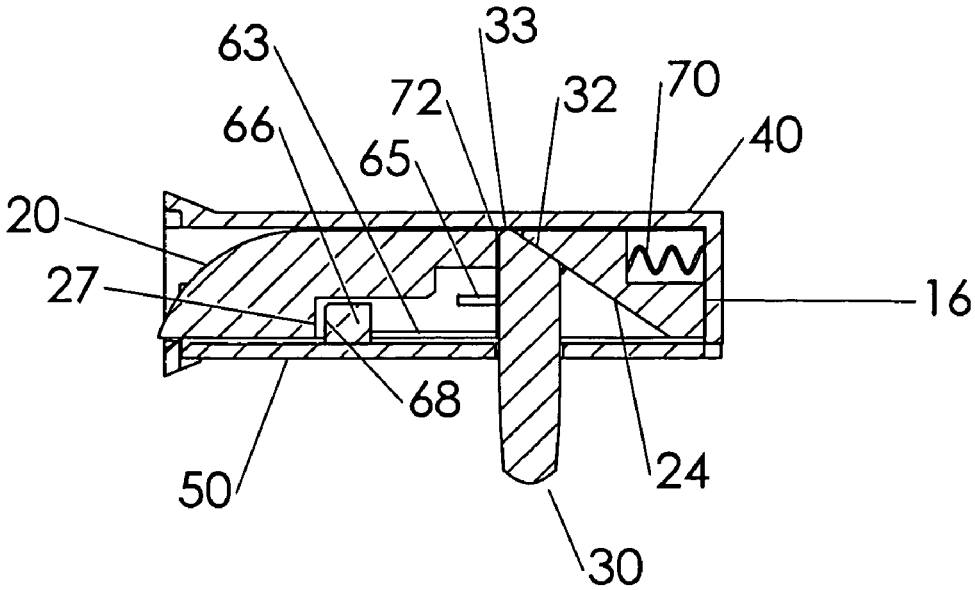
FIG. 17 is a view of the latch bolt mechanism of FIG. 16 taken along the line B-B, illustrating the contact between a spindle and the bolt.

The principal components of a preferred embodiment of the present invention are generally disclosed in FIG. 2. The push-pull latch bolt mechanism 10 is comprised of a bolt 20, at least one push-pull spindle 30, a housing 40 with a cover 50, an optional transversely operable lock 60, and at least one bolt spring 70. The bolt 20 is slidably mounted within the housing 40 for linear movement between an extended position (illustrated in FIG. 13) and a retracted position (illustrated in FIG. 16), and is secured in place by cover 50. The cover 50 in turn is secured to the housing 40 by rivets, bolts or other means known in the art. In the preferred embodiment shown, two spindles 30 are slidably mounted through openings in the housing 40, cover 50 and bolt 20 for movement substantially transverse to the line of travel of the bolt 20. Bolt springs 70 bias the bolt 20 in the extended position. Although two compression springs are shown, other types and number of springs may be used with the latch bolt mechanism of the present invention, e.g., a single leaf spring or other equivalent. Lock 60 is slidably mounted within a lock guide channel 25 defined within bolt 20 (see FIGS. 4 and 7) for movement between a locked position and an unlocked position. The unlocked position is illustrated in FIGS. 12, 14 and 17.

Figure 8:
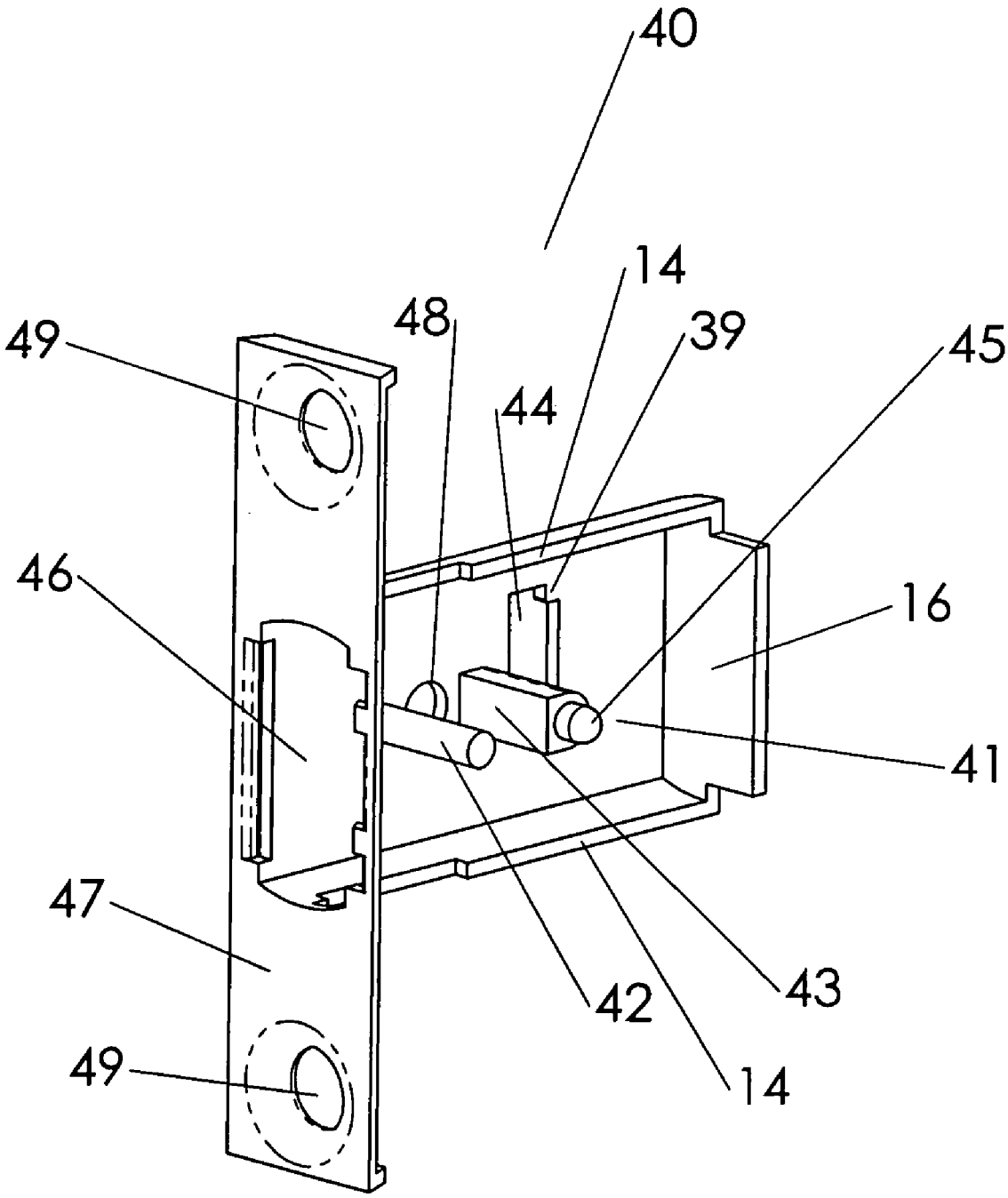
FIG. 8 is an isometric view of the housing component of the push-pull latch bolt mechanism.

The housing 40 (FIG. 8) includes side walls 14 and an end wall 16 for securing the bolt 20 within the housing 40. End wall 16 supports one end of bolt springs 70 to bias the bolt 20 in its extended position, as shown in FIGS. 12 and 14. Also included on housing 40 are support 41, lock guide pin 42, a spindle opening 44 whose side wall supports and guides the spindle, a spindle corner detent 39 for engagement with spindle 30 to ensure its proper orientation with respect to the housing 40, a face plate 47 with screw holes 49 for securing the latch mechanism to a door, a bolt opening 46, and a lock access opening port 48. Support 41 has a flat engagement surface 43 that acts as a stop upon engagement with lock 60, and also defines a generally cylindrical attachment stake 45 at its outer end for engaging the stake hole 56 in cover 50. The lock guide 42 and a guide hole 64 in lock 60 (FIG. 10) are axially aligned so that the lock 60 is slidably mounted on the lock guide 42 for proper movement transverse to the line of travel of bolt 20. The free end of lock guide 42 is aligned and mates with lock guide aperture 54 of cover 50 when cover 50 is secured to the housing 40. The actuation port 62 of lock 60 is also axially aligned with the housing lock access port 48 to permit attachment of an external lock actuator (not shown) to the actuation port 62 of the lock 60 through actuation port 62. An external lock actuator is used to slide the lock 60 between the locked and unlocked positions, as discussed more fully below.

Figure 9:
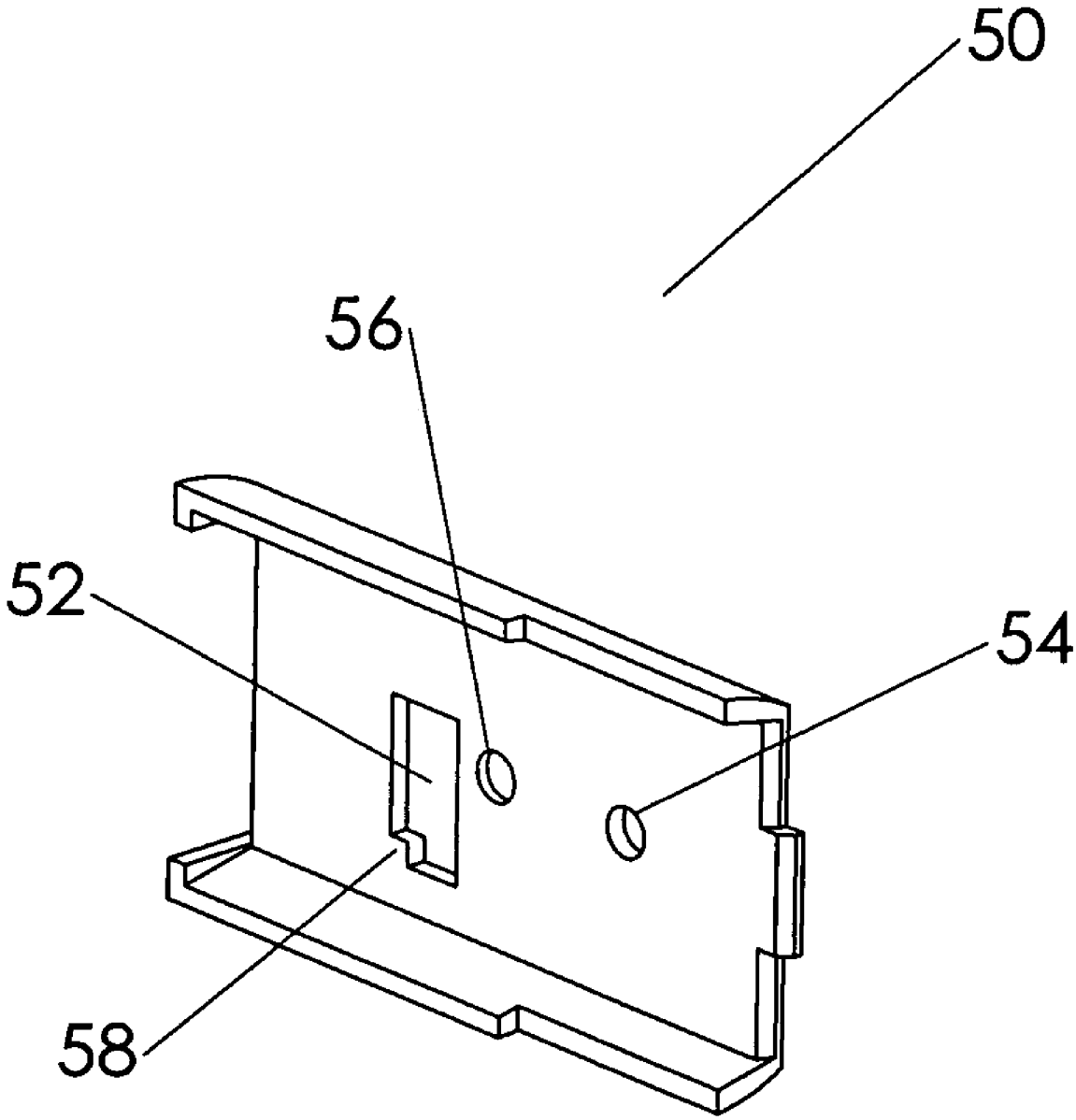
FIG. 9 is an isometric view of a cover component of the push-pull latch bolt mechanism.

The cover 50 (FIG. 9) includes a spindle opening 52 whose side wall supports and guides the spindle 30, a lock guide aperture 54, and a stake hole 56. The spindle opening 52 incorporates a cover corner detent 58 for engagement with spindle 30 to ensure its proper orientation, as described more fully below.

The lock guide 42 and support 41 maintain the cover 50 in proper position with respect to the housing 40. When the housing 40 and cover 50 are secured together, the spindle opening 52 of cover 50 and the spindle opening 44 of the housing 40 are properly aligned for receiving and maintaining the spindles 30 in their proper orientation. The bolt 20 is slidably mounted between the housing 40 and cover 50.

Figure 3:
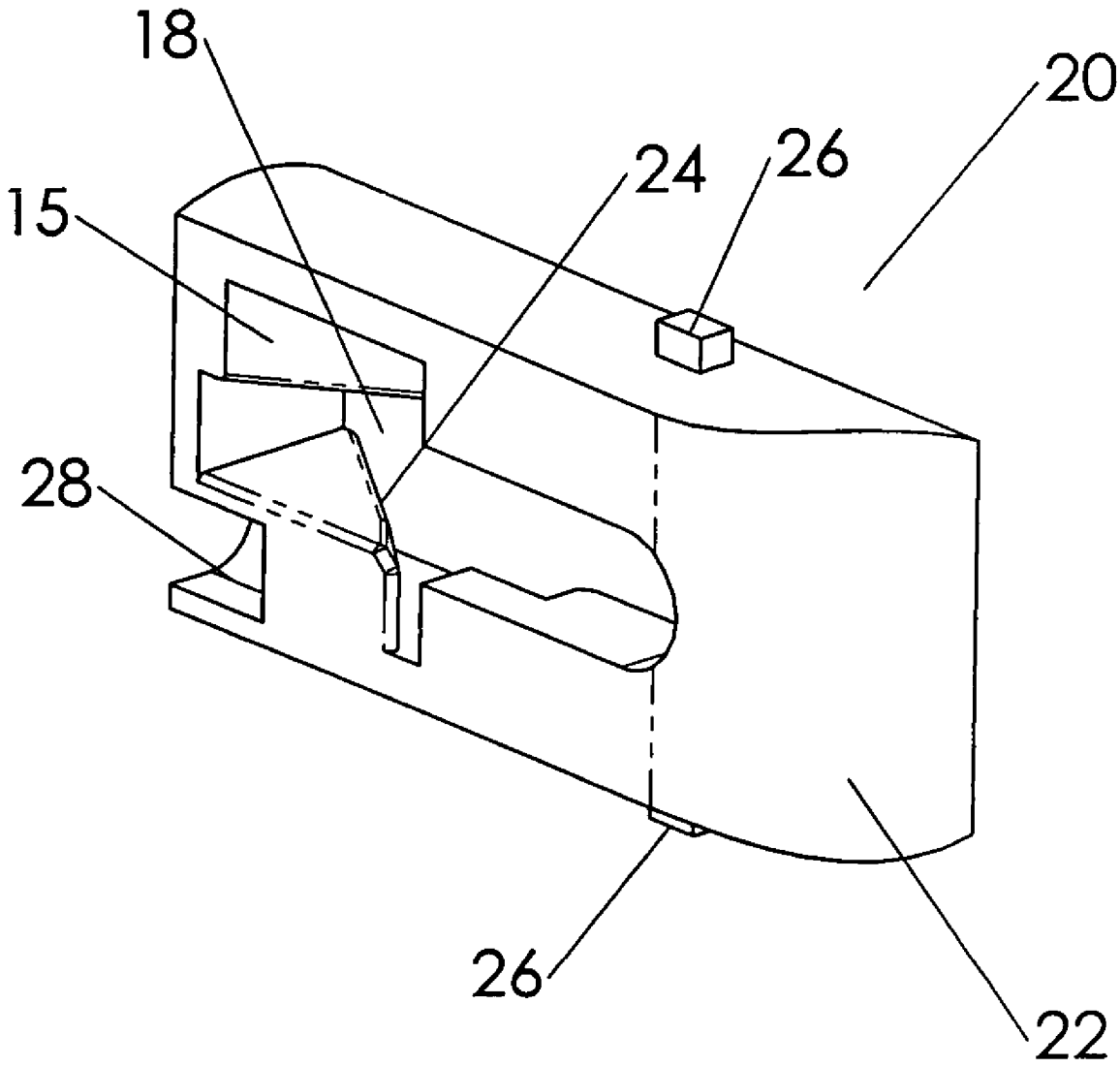
FIG. 3 is an isometric view of the bolt component of the push-pull latch bolt mechanism.
Figure 4:
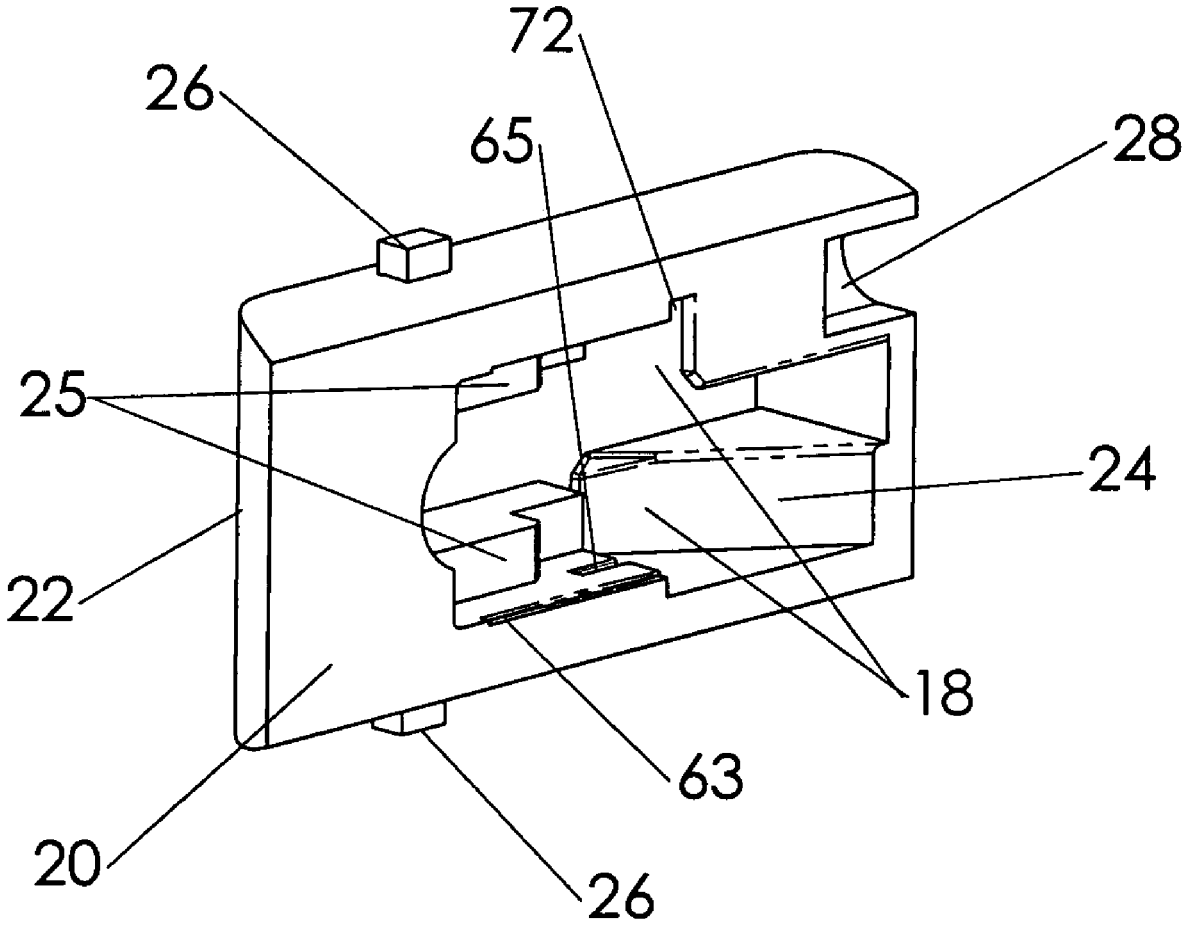
FIG. 4 is an isometric view of the bolt component of the push-pull latch bolt mechanism from the side opposite that shown in FIG. 3.
Figure 5:
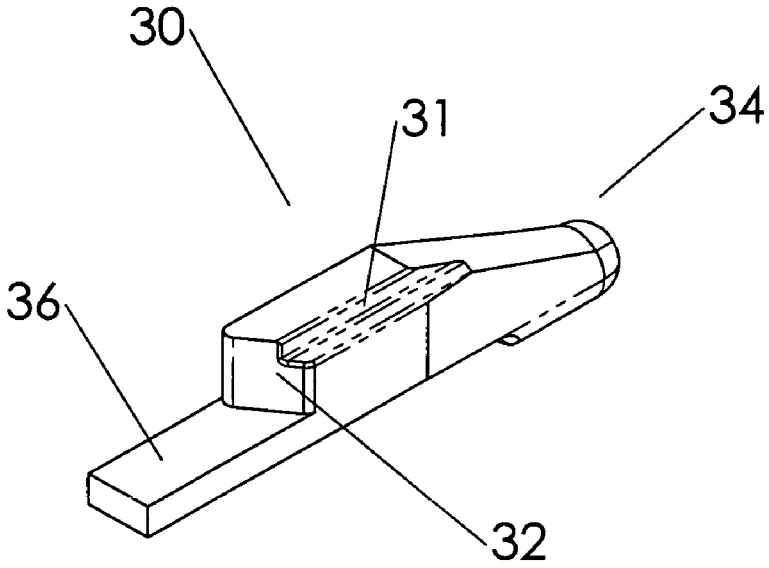
FIG. 5 is an isometric view of the spindle component of the push-pull latch bolt mechanism.
Figure 6:
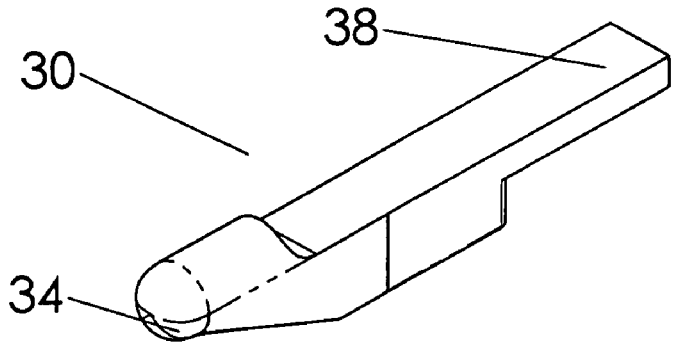
FIG. 6 is another isometric view of the spindle component of the push-pull latch bolt mechanism.

Referring to FIGS. 3 and 4, the bolt 20 includes two actuation inclines or angled surfaces 24 and 15 that oppose each other. These actuation inclines are aligned at approximately 40 degree angles with respect to the line of travel of the bolt 20, and at an angle of approximately 90 degrees with respect to each other. As shown more fully in FIGS. 5 and 6, in one preferred embodiment, the spindles 30 each include an interface surface 38, a semi-spherical free end 34 (other shapes are possible), a support surface 36 opposite that of interface 38, an orientation slot 31 that is aligned with the corner detent 39 of housing 40 or corner detent 58 of cover 50, and an inclined surface 32. When the housing 40, cover 50 and bolt 20 are assembled, spindle openings are created by the alignment of the housing spindle opening 44, the cover spindle opening 52 and bolt spindle opening 18. The spindles 30 are therefore inserted into the housing 40 from opposite sides of the housing 40, such that the inclined surfaces 32 of the spindles 30 are in contact with the actuation inclines 24 and 15 of bolt 20 and the semi-spherical ends 34 of the spindles 30 extend outwardly from the housing 40 for engagement with a handle (not shown). This is the normal or "home" position of the spindles that allows bolt 20 to be biased by springs 70 into the extended position.

Figure 15:
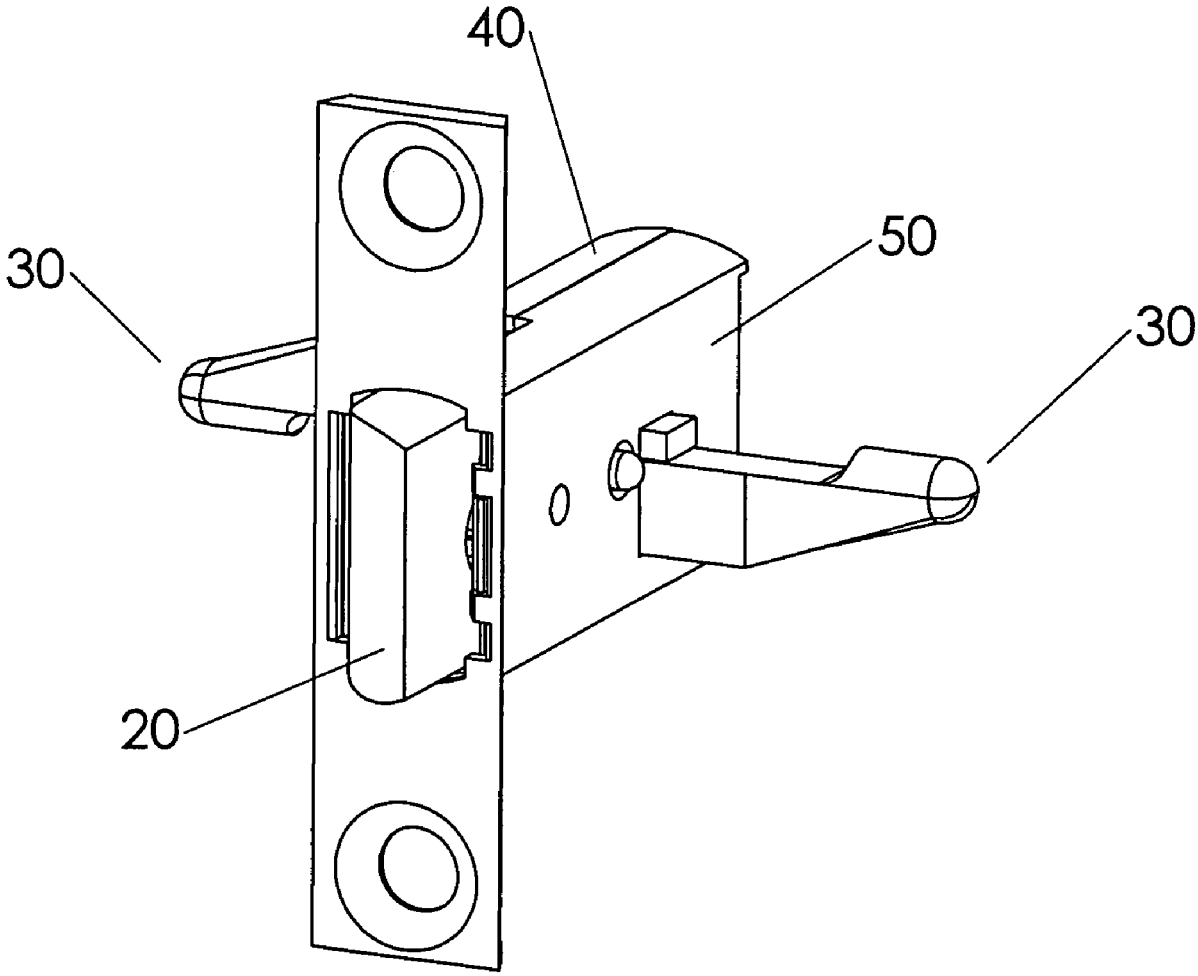
FIG. 15 is an isometric view of the latch bolt mechanism, illustrating the mortise plate, and the "home" position of the spindles with the bolt in its normal or extended position.

The spindles 30 are mounted one on top of the other, facing in opposite directions, such that interface surfaces 38 of the spindles 30 are in contact with each other. The support surfaces 36 of spindles 30 are supported by the bolt 20 as it is moved between its retracted (disengaged) and extended (engaged) positions. When an inward directed force is applied to the semi-spherical end 34 of spindle 30 (see the left spindle 30 in FIG. 15), the spindle 30 (mounted from the side of the housing 40) is pushed partially through the housing 40, and the inclined surface 32 of spindle 30 engages the inclined surface 15 of the bolt 20. When an inward directed force is applied to the semi-spherical end 34 of spindle 30 mounted from the side of the cover 50 (see the right spindle 30 in FIG. 15), the spindle 30 is pushed partially through the cover 50 and the inclined surface 32 of spindle 30 engages the inclined surfaces 24 of the bolt 20. Movement of the inclined surfaces 32 of the spindles 30, transverse to the line of travel of the bolt 20, against the inclined surfaces 15 or 24 of the bolt 20, translates energy to the bolt 20. The force asserted by the spindles 30 on bolt 20 overcomes the opposing bias of bolt springs 70 and translates to angular movement of the bolt 20 (generally perpendicular with respect to the line of motion of the spindles 30) such that the bolt 20 moves from its (biased) extended position, as shown in FIG. 12, to its retracted position, as shown in FIG. 17, so that the door may be freely opened. The spindle interface surfaces 38, the spindle opening 52 in cover 50 and spindle opening 44 in housing 40 confine the translation of the spindles 30 to be angular to the movement of the bolt 20.

When the force on the spindle 30 is released, the force of the bolt springs 70 causes the bolt 20 to return to its extended position, and the spindles 30 to return to their home (disengaged) position. The spindles 30 are also independently operable, so that the door latch bolt mechanism can be opened from either side of the door.

Figure 33:
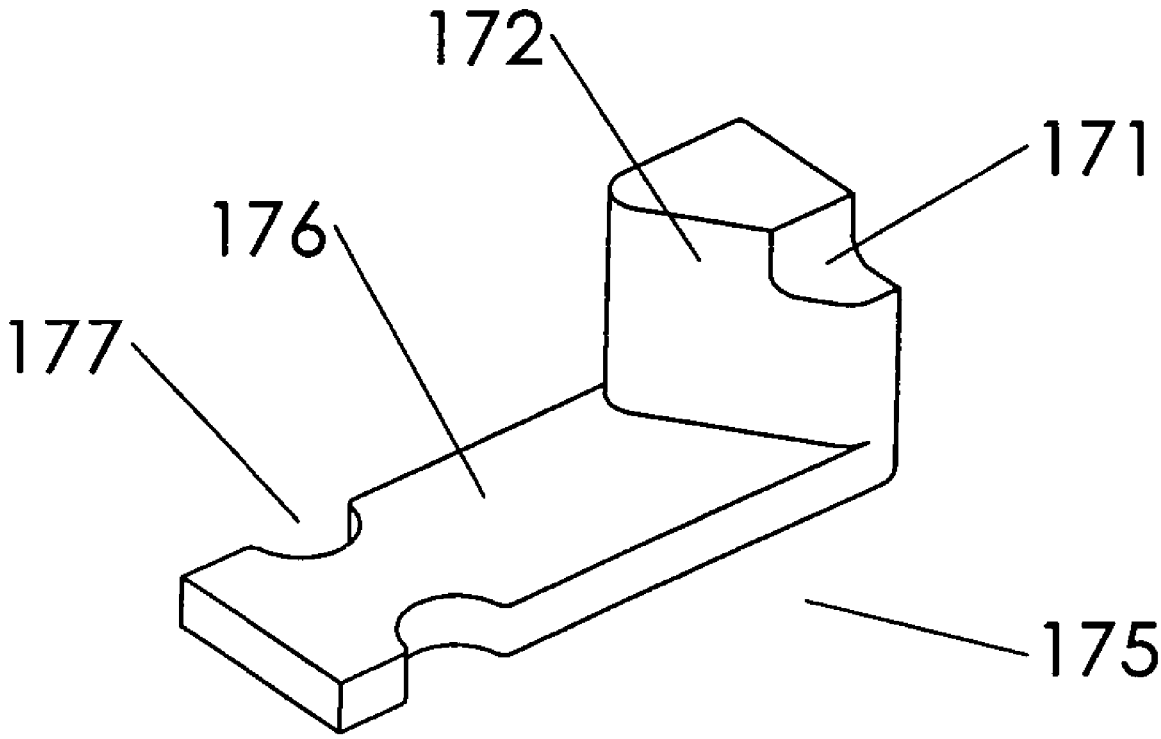
FIG. 33 is an isometric view of a pull-actuated spindle.

Reference is now made to FIG. 33, which illustrates a pull spindle 175. In this view, an actuator is connected to the spindle 175 by means of spindle notches 177, although other connection arrangements are possible and well known in the art. FIG. 33 also illustrates inclined surface 172 for engaging a corresponding inclined surface of a bolt, the orientation slot 171, and support surface 176.

Figure 7:
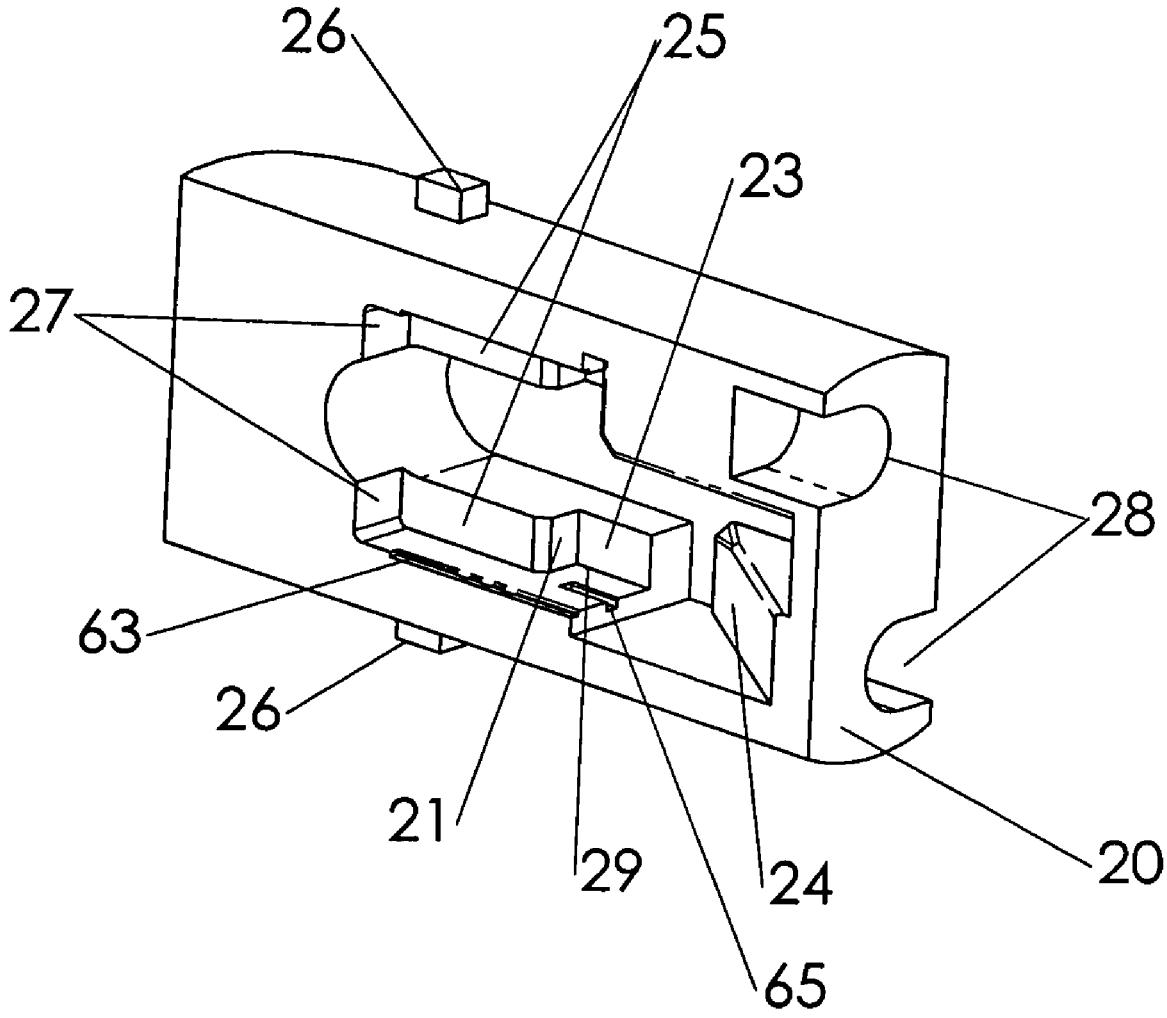
FIG. 7 is an isometric view of the bolt component of the push-pull latch bolt mechanism.

Referring to FIGS. 4 and 7, bolt 20 includes: a rounded strike contact surface 22 for engaging either a strike plate or door frame edge (not shown); opposing lock guide channels 25 for permitting movement of the bolt 20 with respect to the lock 60; a flat locking surface 21 for engaging the placement stops 66 of lock 60 (see FIG. 10); a lock stop surface 23 for engaging a stop surface 67 of the lock 60; extension stops 26 for limiting the extension of the bolt 20 with respect to the housing 40; and staggered, opposite facing spring retainers 28 for engaging one end of the bolt springs 70. When the bolt 20 is mounted within the housing 40, one end of the bolt springs 70 nest within the spring retainers 28. The other end of the bolt springs 70 engages the housing end wall 16 to bias the bolt 20 forward in its extended position.

Figure 10:
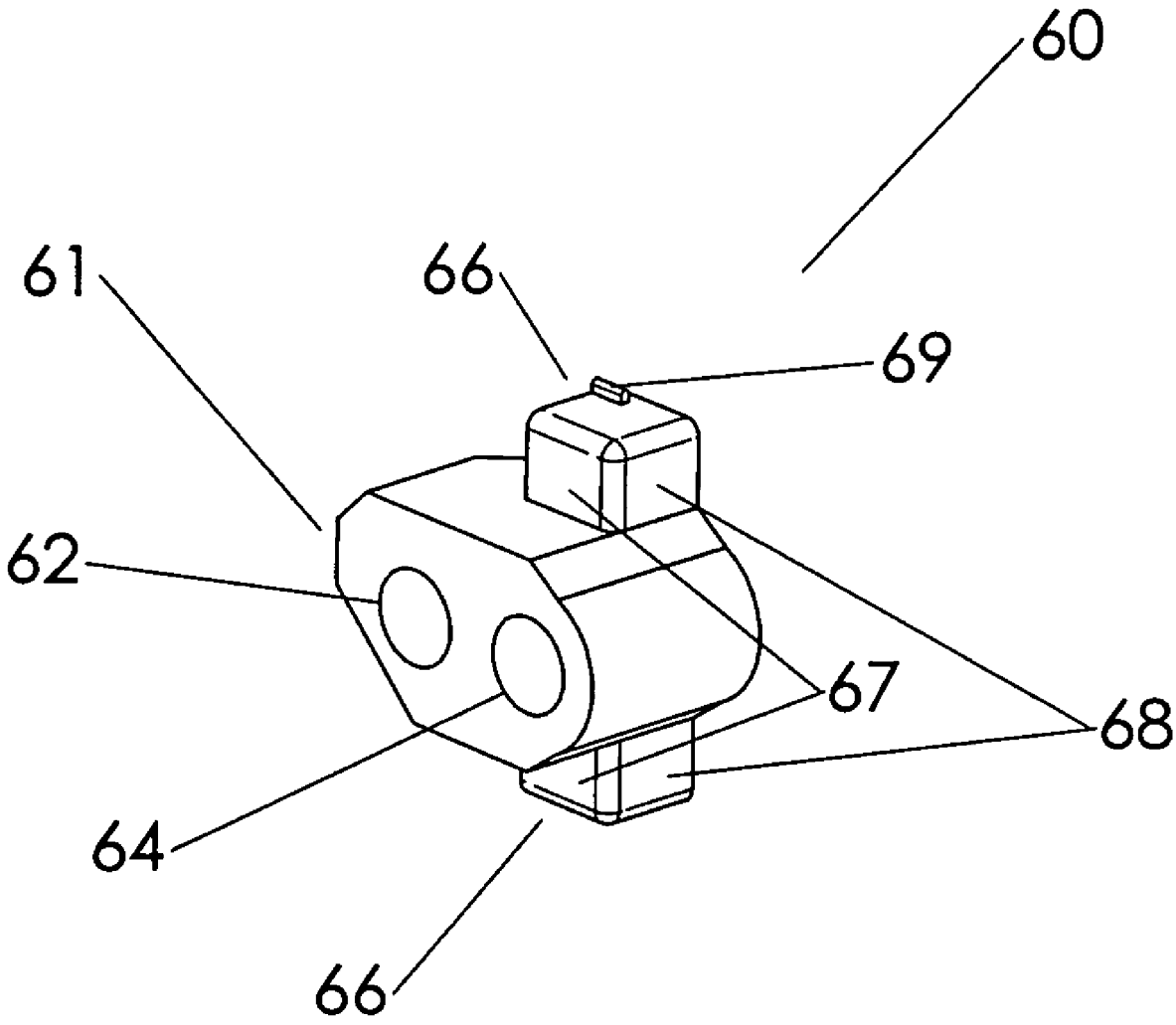
FIG. 10 is an isometric view of an optional lock component.
Figure 11:
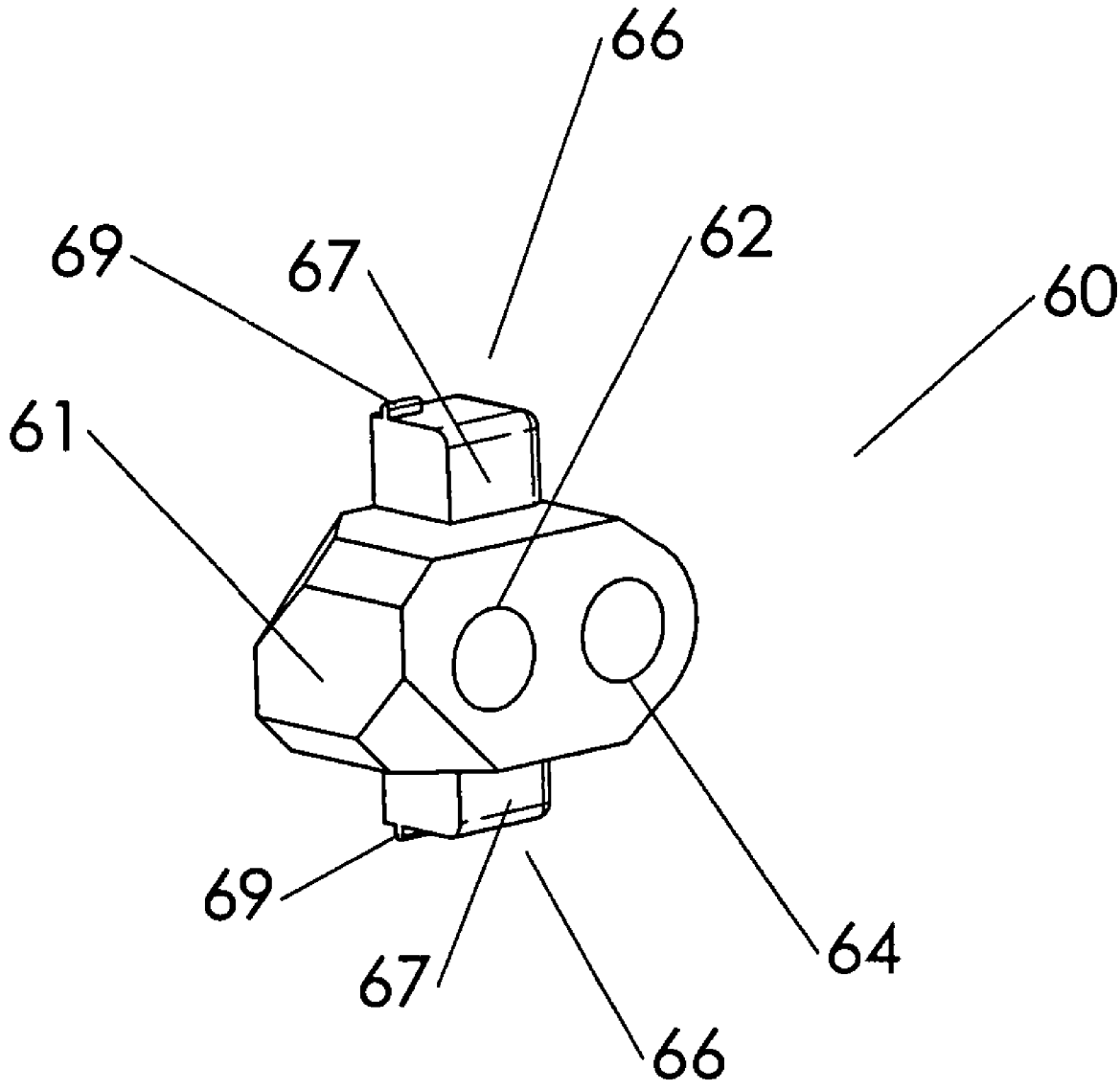
FIG. 11 is an alternate isometric view of the optional lock component shown in FIG. 10.

Referring to FIGS. 10 and 11, the lock 60 includes: placement stops 66 with abutment surfaces 68 that engage guide channel end surfaces 27 of bolt 20 when bolt 20 is fully retracted; a lock actuation port 62 for attachment to an external lock actuator (not shown); a guide hole 64 for receiving housing lock guide 42; a bearing surface 61 for engaging support engagement surface 43 of the housing 40 (FIG. 8); and a stop surface 67 for engaging lock stop surface 23 of bolt 20 (FIG. 7) when the lock 60 is moved to the locked position. The lock 60 is slidably mounted on the housing 40 with the free end of lock guide 42 of housing 40 extended through the guide hole 64 of lock 60. In this orientation, the lock 60 can only move axially with respect to the longitudinal axis of the lock guide 64, which is transverse to the direction of travel of the bolt 20.

Bolt 20 is slidably mounted with respect to housing 40 and lock 60. Two lock guide channels 25 are defined in bolt 20 (FIG. 7) to permit bolt 20 to move with respect to lock 60. The lock channels 25 are recessed and opposed to receive the placement stops 66 of lock 60. Spindle clearance is provided by the bolt spindle opening 18 when the bolt 20 is in the extended position. Bolt 20 is free to move between the extended and retracted positions as long as the placement stops 66 of bolt 60 are in alignment within the lock guide channels 25 (the unlocked position of the lock 60).

The bolt 20 may be locked in its extended position by pushing the lock 60 inward along the longitudinal axis of the lock guide 42, so that the lock placement stops 66 are positioned within a locking recess 29 defined in bolt 20 in engagement with lock stop surfaces 23 of bolt 20. This constitutes the locked position of lock 60 and bolt 20. Engagement of the bearing surface 61 of lock 60 with the flat surface 43 of the housing support 41 helps guide the lock 60 when moved between its locked and unlocked position and provides additional support if a retraction force is applied to the bolt 20 when in the locked position.

When in the locked position, bolt 20 is prevented from being retracted by the engagement of the lock tabs 66 with lock contact surface 21 of the bolt 20. In the locked position, a door can be secured in a closed orientation, and spindles 30 become inoperable with respect to bolt 20. The latch bolt mechanism 10 may be constructed with or without incorporation of the lock 60.

The bolt 20 and lock 60 can also be designed with a catch mechanism to better secure the lock 60 in either the locked or unlocked orientation. One possible embodiment is illustrated in FIGS. 4 and 10. The lock 60 includes one or more catch pegs 69 that releaseably engage an unlocked catch channel 63 or locked catch channel 65 formed along the lock guide channels 25 of bolt 20. When bolt 20 is moved between the extended position and the retracted position with the lock 60 in the unlocked position, the catch peg 69 freely slides along the unlocked catch channel 63. This engagement prevents the lock 60 from unintentionally moving out of the unlocked position. When the bolt 20 is in the extended position, the lock 60 may be moved to the locked position. The material of which the bolt 20 and/or the lock 60 are comprised allows some flex between the catch peg 69 and unlocked catch channel 63. Upon application of an external force on the lock 60 to move it from the unlocked position to the locked position, catch peg 69 will disengage the unlocked catch channel 63 and engage the locked catch channel 65. This secures the lock 60 in the locked position until another external force is applied to move lock 60 to the unlocked position.

Other methods may be employed to create a catch mechanism for the present invention. By way of example and not limitation, instead of catch channels, a raised area could be designed in the bolt (approximately midway between the location of where the catch channels were positioned), which would need to be overcome to permit movement of the lock between the locked and unlocked positions. Other possible catch mechanisms are known in the art.

Figure 13:
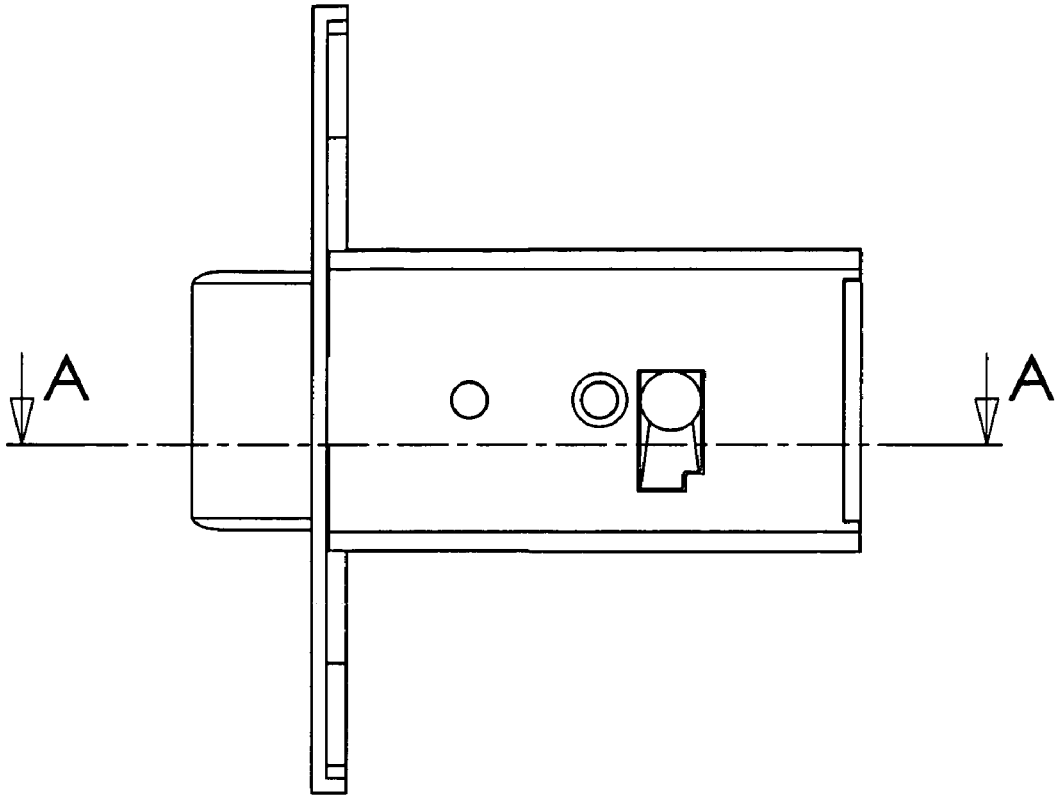
FIG. 13 is a (cover) side view of the latch bolt mechanism, with the bolt in its extended position and the spindle positioned to engage and retract the bolt.
Figure 14:
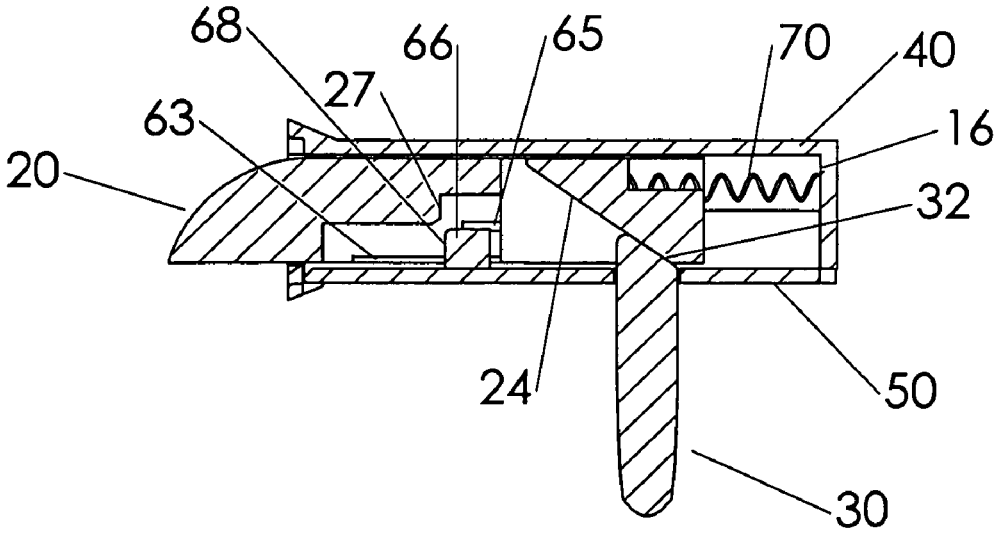
FIG. 14 is a view of the latch bolt mechanism of FIG. 13 taken along the line A-A, illustrating the contact between a spindle and the bolt.

Operation of the push-pull latch bolt mechanism 10 of the present invention is illustrated in FIG. 14, which is a sectional view of the latch mechanism 10 as shown in FIG. 13, with bolt 20 extended. As the semi-spherical end 34 of spindle 30 (shown in FIG. 5) is pushed towards the housing 40, inclined surface 32 of spindle 30 engages the inclined surface 24 of the bolt 20, thereby causing bolt 20 to be retracted towards the end plate 16 of the housing 40, compressing bolt springs 70. The result is shown in FIGS. 16 and 17, illustrating bolt 20 in its retracted position, with bolt springs 70 compressed and a leading tip 33 of inclined surface 32 of spindle 30 extending partially through a spindle extension opening 72.

Figure 18:
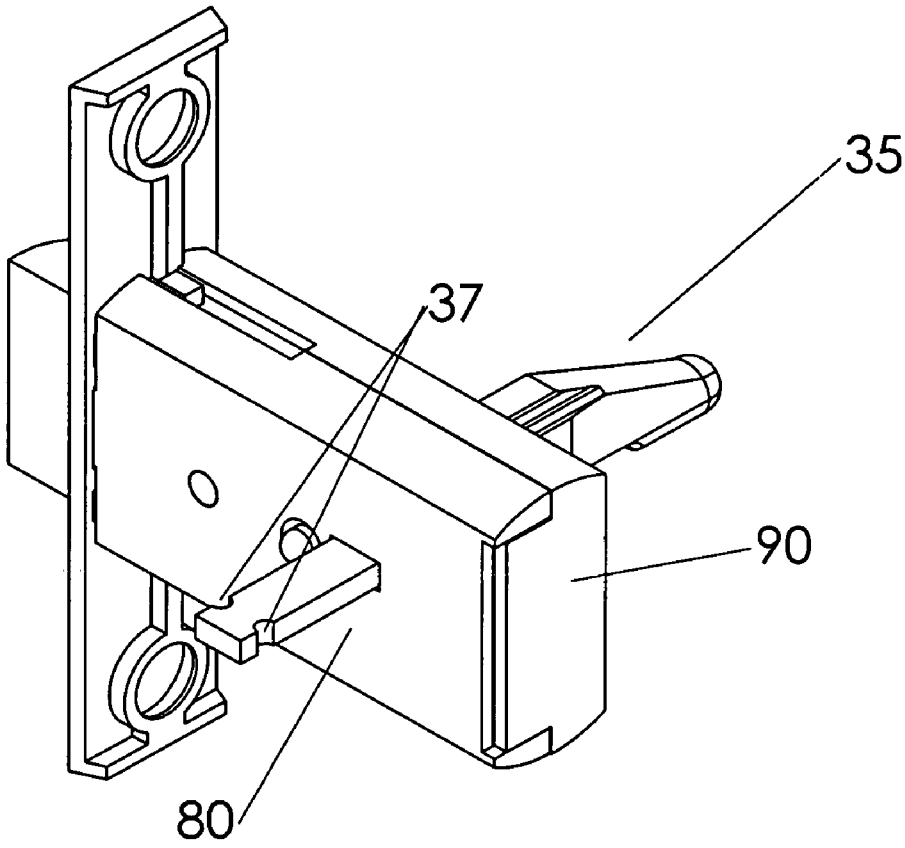
FIG. 18 is a an isometric view of the latch bolt mechanism with the bolt in an extended position, illustrating a modified version of a single spindle for "push and pull" actuation of the bolt to its retracted position.
Figure 19:
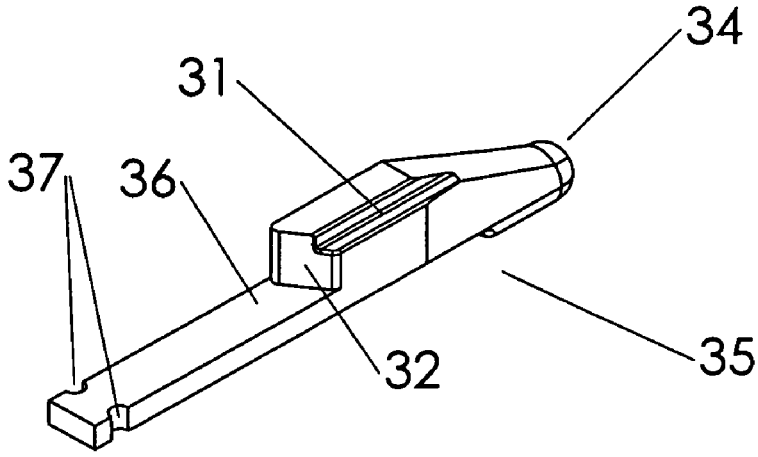
FIG. 19 is an isometric view of an alternate embodiment of the spindle used for "push and pull" actuation of the bolt.
Figure 20:
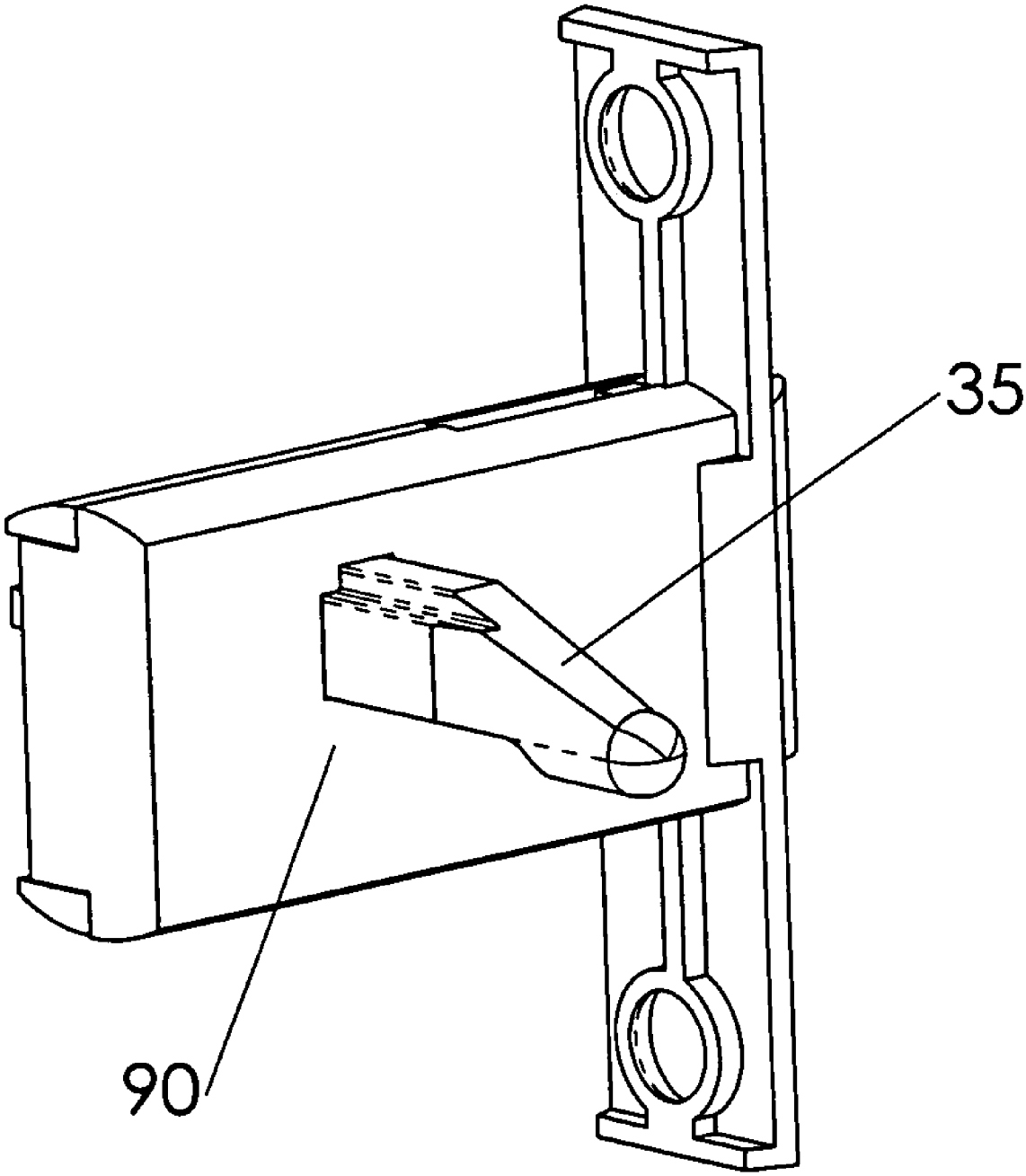
FIG. 20 is an isometric view of the latch bolt assembly illustrating an alternate embodiment of the spindle utilized for "push and pull" actuation of the bolt.

An alternative single-spindle version of the latch mechanism is illustrated in FIGS. 18, 19 and 20. A single spindle 35 with an orientation slot 31 is mounted to alternate housing 90 and alternate cover 80. The orientation slot 31 aligns with a corner detent 39 in alternate housing 90 to maintain proper alignment of the alternate spindle 35 with respect to the alternate housing 90. The alternate spindle 35 further includes spindle notches 37 which may be engaged by an external actuator (not shown) to draw the alternate spindle 35 out of the alternate housing 90, in the direction of the spindle notches 37. When drawn out, the inclined surface 32 of the alternate spindle 35 engages an inclined surface of the bolt 20 to cause the bolt 20 to retract into the alternate housing 90. Alternate spindle 35 is thus "pulled" to cause retraction of the bolt 20.

Latch bolt mechanism 10 may be modified so that the detail shown in the bolt 20 for receiving the lock 60 could be carried in the cover 50 or housing 40, and the lock 60 could be mounted on and carried with the bolt 20 for both movement with and movement transverse to the line of travel of the bolt 20. Movement of the lock between its locked and unlocked positions could also be achieved by mechanical means, such as inclusion of an additional longitudinal slot in the housing 40 or cover 50 aligned with the line of travel of the bolt 20, or by other means (magnetic, etc.).

Figure 21:
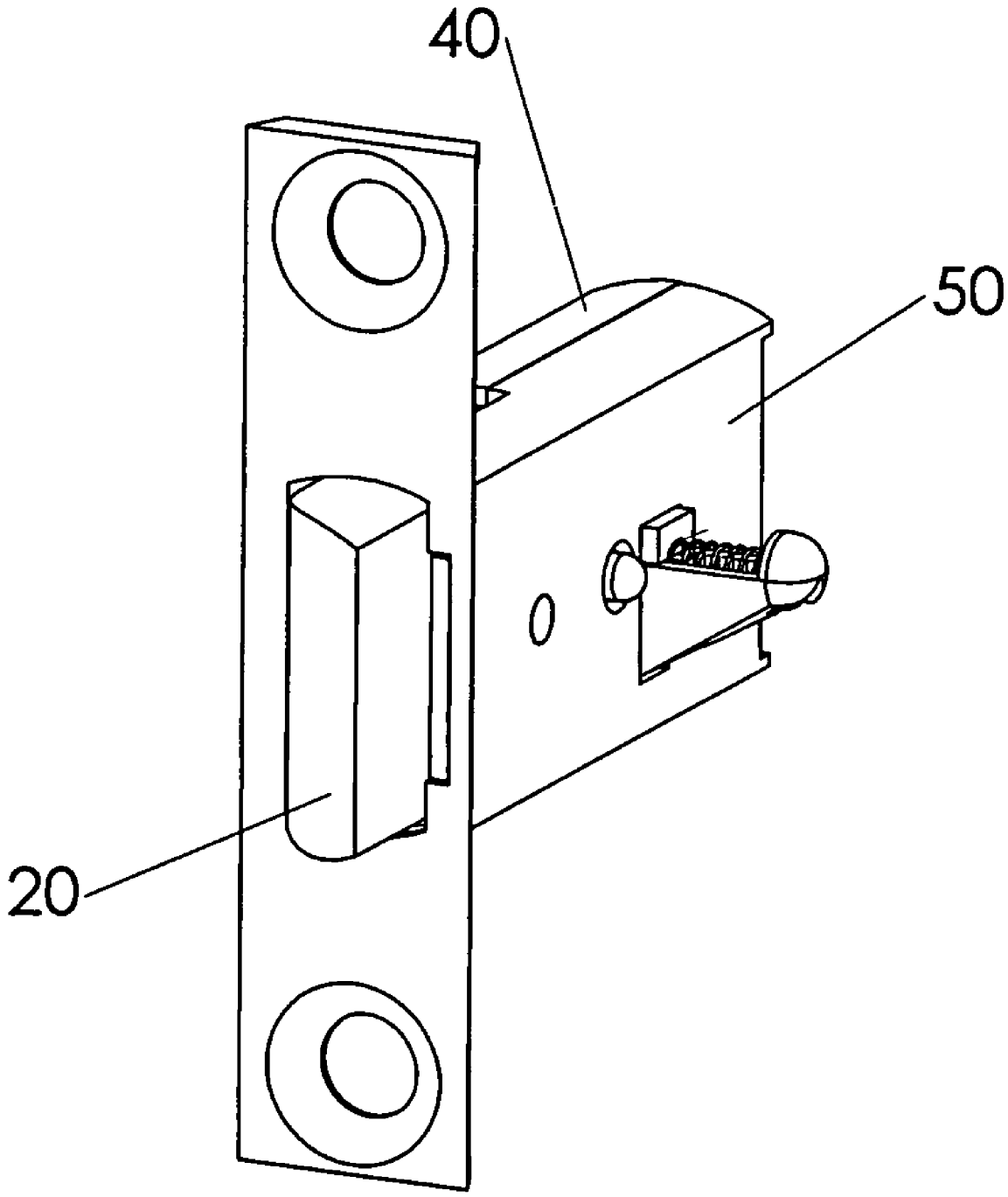
FIG. 21 is an isometric view of an alternative embodiment of the latch bolt mechanism, which includes spindle return springs incorporated within each spindle.
Figure 22:
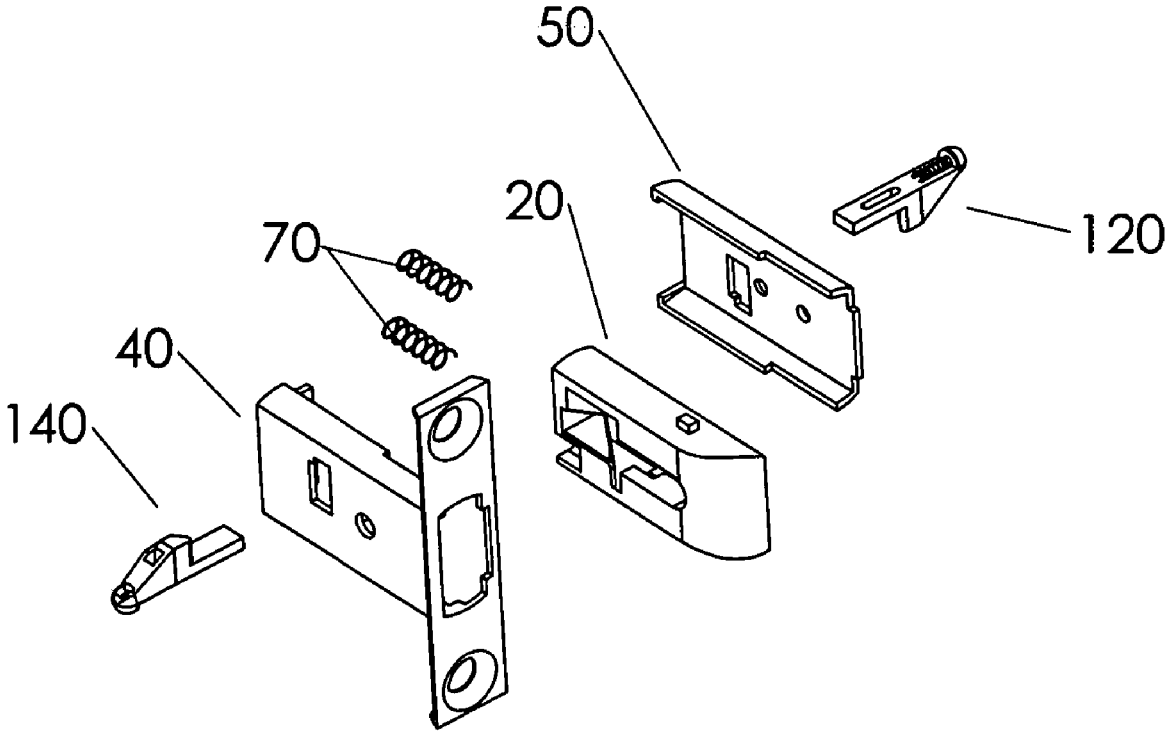
FIG. 22 is an isometric exploded view of FIG. 21.

In yet another preferred embodiment, the spindles may be further enhanced and equipped with spindle return springs 130. Referring to FIG. 21, this embodiment of the push-pull latch mechanism 10 includes bolt 20, housing 40, cover 50 and spring-loaded spindles 100. An exploded view of this embodiment of the push pull latch mechanism 10 is illustrated in FIG. 22. The housing 40, cover 50, and bolt 20 remain substantially unchanged from the previous embodiments discussed above. For reasons delineated below, bolt springs 70 may be of lighter construction and duty than otherwise required.

Figure 23:
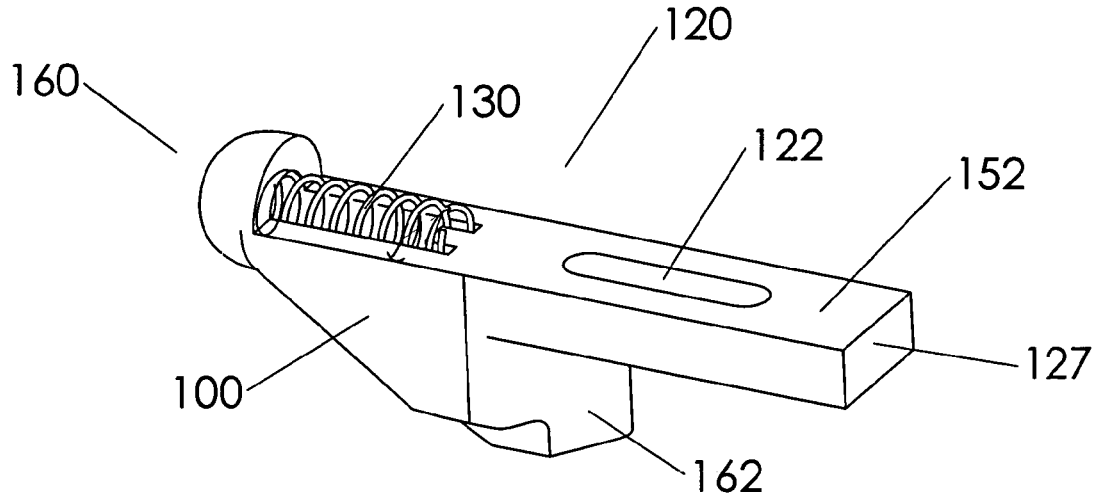
FIG. 23 is an isometric view of a receiving spindle with a spindle return spring.
Figure 24:
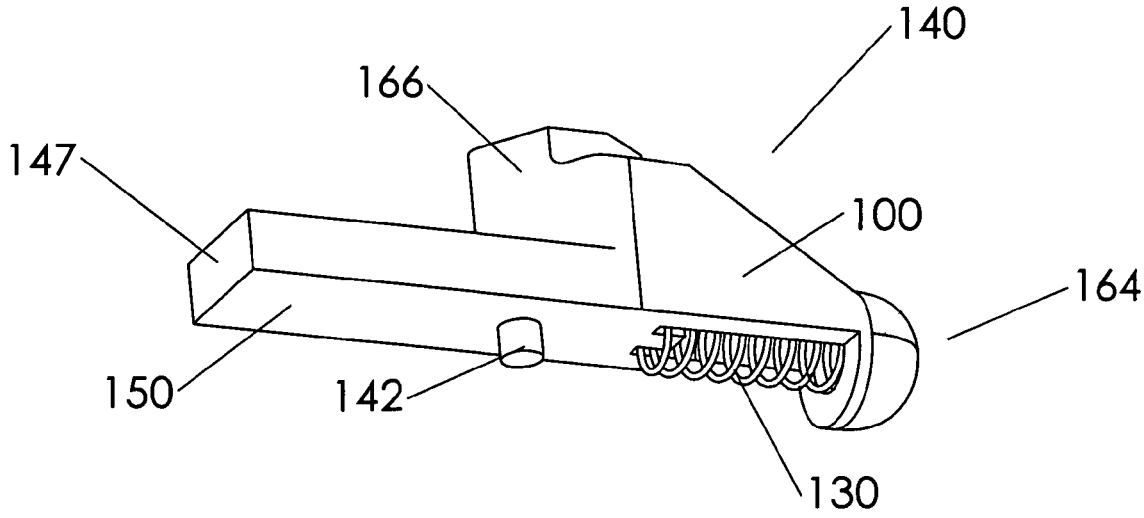
FIG. 24 is an isometric view of a protruding spindle with a spindle return spring.

FIGS. 23 and 24 illustrate two types of spring-loaded spindles 100, including protruding spindle 140 and receiving spindle 120. ("Spindles 100" is used herein to refer to spring-loaded spindles in general; references to the protruding spindle 140 or the receiving spindle 120 are intended to describe the illustrated embodiments shown in FIGS. 23 through 32.)

Figure 25:
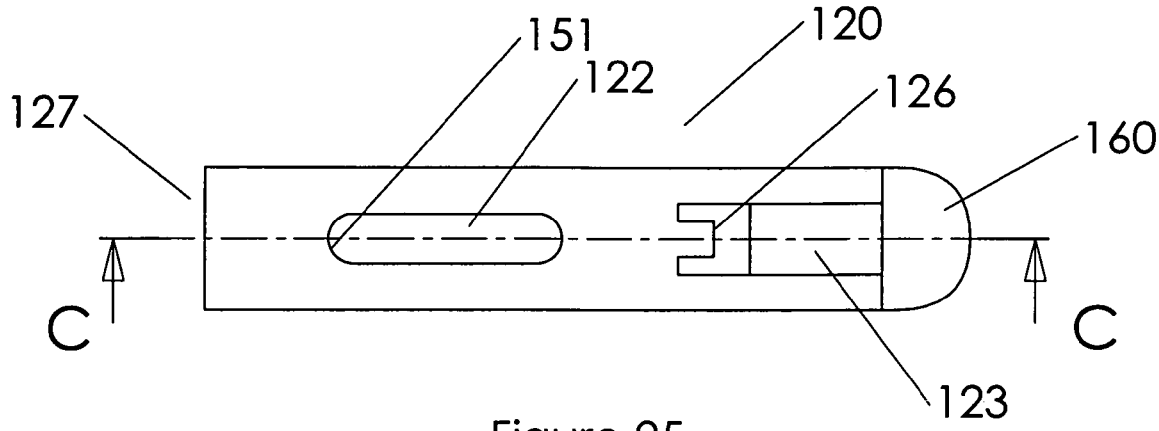
FIG. 25 is a plan view of the receiving spindle.
Figure 26:
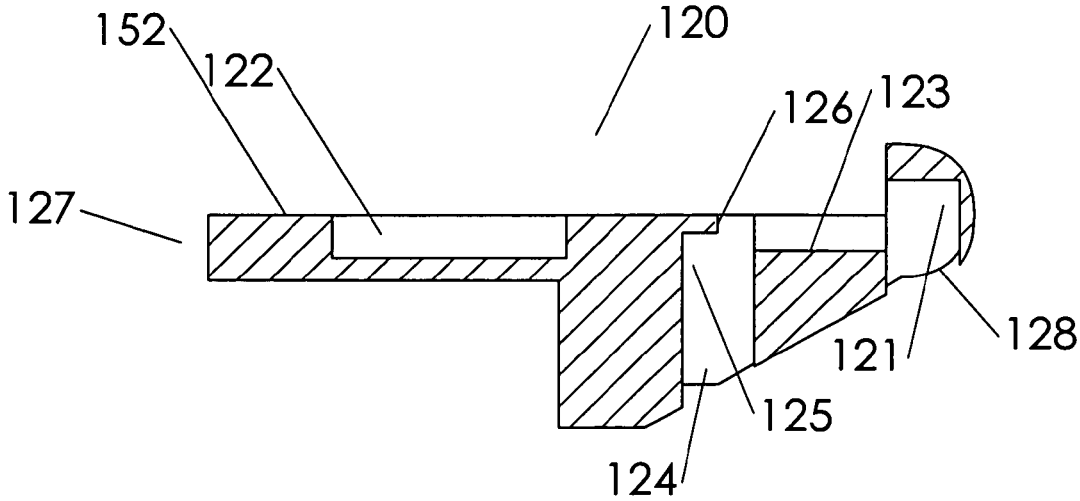
FIG. 26 is a sectional view of the receiving spindle taken along line C-C as shown in FIG. 25.

Receiving spindle 120 is equipped with a tail end 127, semi-spherical head (end) 160, and spring receiving slot 123 formed or cut in a slide surface 152 of the receiving spindle 120. An inclined engagement surface 162 of the receiving spindle 120 (see FIG. 23) is designed to engage a corresponding inclined surface of the bolt 20 as described above. The spring receiving slot 123 receives a spindle return spring 130 (FIGS. 25 and 26). The return spring 130 is restrained within the spring receiving slot 123 at a first end by a protrusion or boss 126 and abutment surface 125. The boss 126 extends into the first end of the return spring 130, and the end of the return spring 130 is supported against the abutment surface 125. A second end of the return spring 130 is secured within a chamber 121 formed within a spindle head 160 of receiving spindle 120. The chamber 121 defines an abutment surface 128 and is of sufficient diameter to receive the second end of the spindle return spring 130. By engaging each end of the spindle return spring 130, the spindle return spring 130 is prevented from being inadvertently dislodged from the spring receiving slot 123 during operation of the latch mechanism 10. It should be apparent that other interlocking methods may be applied to this embodiment.

Figure 27:
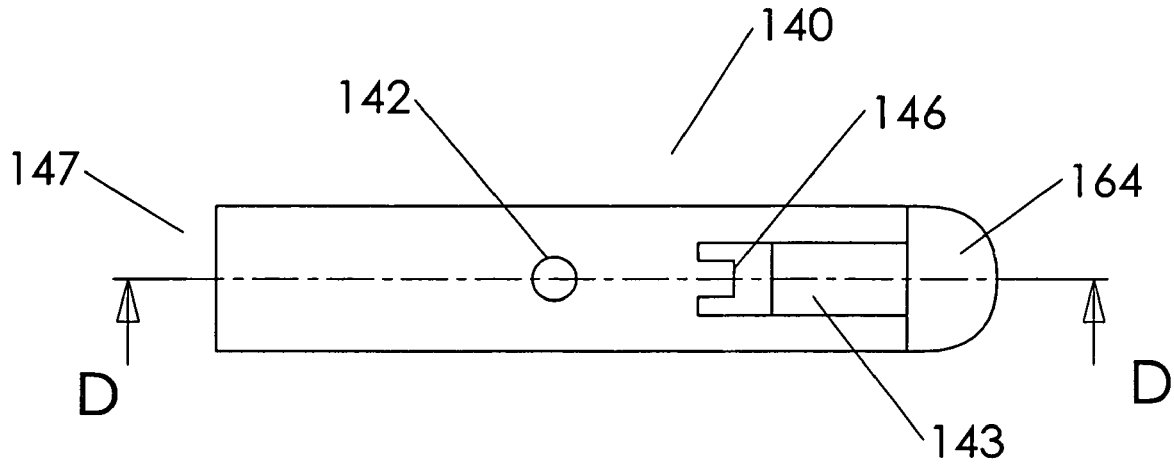
FIG. 27 is a plan view of the protruding spindle.
Figure 28:
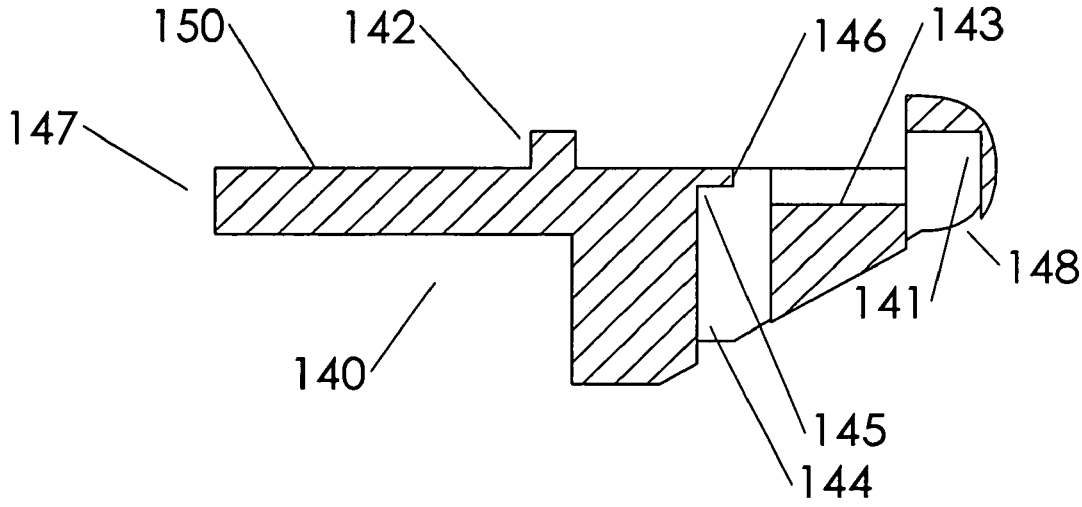
FIG. 28 is a sectional view of the protruding spindle taken along line D-D as shown in FIG. 27.
Figure 29:
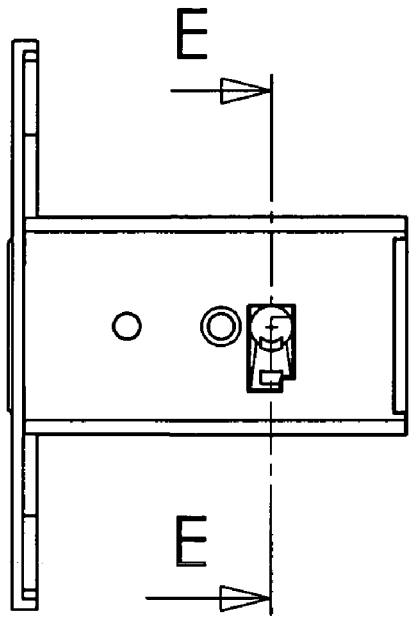
FIG. 29 is a front view of an alternate embodiment of a latch bolt assembly with the bolt retracted.

The receiving spindle 120 also includes an axially aligned boss receiving slot 122 designed to receive a boss 142 extending from a slide surface 150 of protruding spindle 140 (FIGS. 27 and 28). The boss 142 and boss receiving slot 122 are designed to interlock when assembled to prevent inadvertent disassembly during latch installation. Boss receiving slot 122 acts as a guide to axially constrain the protruding spindle boss 142 within the boss receiving slot 122 during actuation of the latch mechanism 10 by movement of either the protruding spindle 140 or receiving spindle 120. The boss 142 is inescapably slidably extended into the boss receiving slot 122 to axially prevent outward translation of the spindles when the boss 142 abuts a tail end 151 of the boss receiving slot 122 nearest the tail end 127 of receiving spindle 120 (FIG. 25). In the neutral or disengaged position, boss 142 moves towards the tail end 151 or the boss receiving slot 122. Other methods may be employed that allow axial movement of the spindles with respect to each other, while preventing disengagement. The boss 142 and receiving slot 122 are but one illustrated method. By way of example, a roller pin may be inserted through one spindle and partially extend into a slot or other guide channel of a second spindle to maintain proper alignment during operation of the spindles.

Protruding spindle 140 is illustrated in detail in FIGS. 27 and 28. Protruding spindle 140 includes spring receiving slot 143, a spring boss 146 and return spring abutment surface 145 for receiving a first end of a return spring 130, a chamber head 148 of the protruding spindle 140 with a spring abutment surface 141 for receiving a second end of a return spring 130, a boss 142 extending outwardly from a slide surface 150, an inclined surface 166 for engaging a corresponding inclined surface of bolt 20, a spindle head 164, and a tail end 147.

Cavity 124 of receiving spindle 120 and cavity 144 of protruding spindle 140 are created during construction of the respective spindles and are identified only to distinguish them from the inclined surfaces 162 and 166. Depending upon the method used to manufacture the spindles, these cavities may not exist, or may exist in alternate form. The same is true for features 128 and 148, provided that an opening is defined to receive the springs 130. However, other embodiments are possible, such as another boss arrangement similar to spring boss 146.

Figure 30:
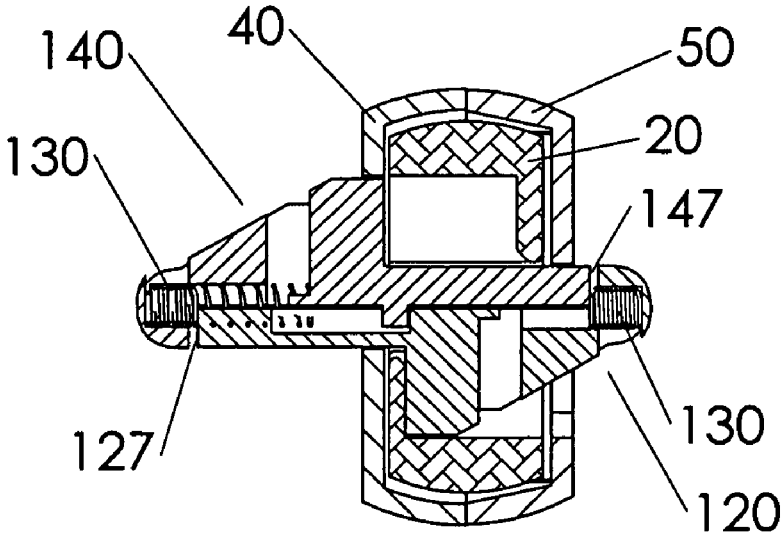
FIG. 30 is a sectional view of the latch bolt assembly of FIG. 29 taken along line E-E as shown in FIG. 29.
Figure 31:
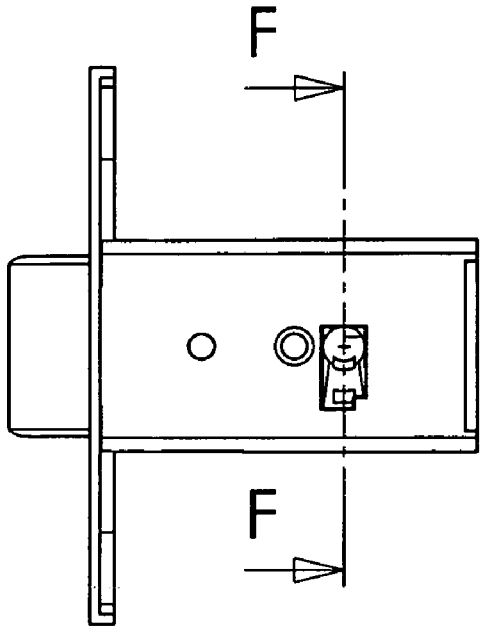
FIG. 31 is a front view of the latch bolt assembly of FIG. 29 with the bolt extended.
Figure 32:
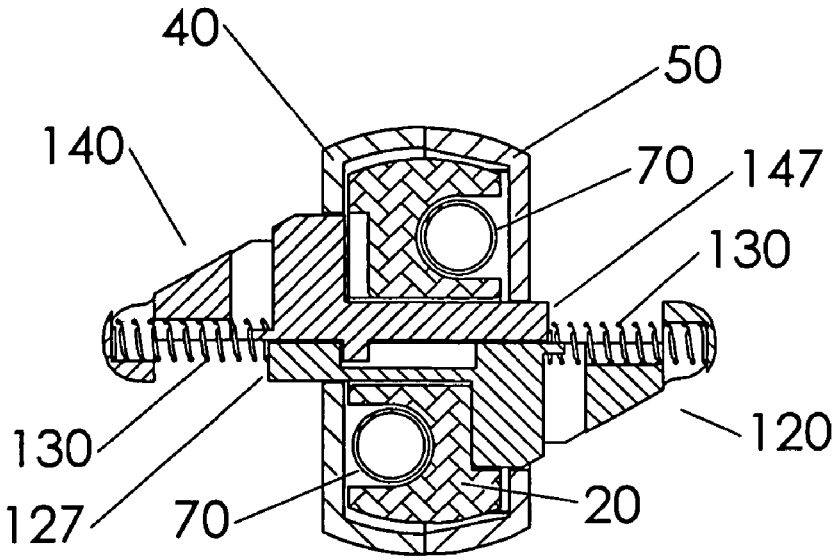
FIG. 32 is a sectional view of the latch bolt of FIG. 31 taken along line F-F as shown in FIG. 31.

When the receiving spindle 120 and protruding spindle 140 are assembled in latch mechanism 10 as shown in FIGS. 31 and 32, the return springs 130 will exert an axial force on the tail ends 127 and 147, respectively, of these spindles, thereby biasing the spindles toward their neutral or disengaged position. The outward extension of the spindles 120 and 140 are limited by the boss 142 engaging one end of the boss receiving slot 122 at position 151. In this orientation, the bolt 20 is in its extended position as shown in FIG. 31. When the head 160 of receiving spindle 120 is pushed inward towards the cover 50 as shown in FIG. 30 (or if the protruding spindle 140 is pushed inward towards the housing 40, or if the tail end of either spindle is pulled outward from the housing), the force on the spindles is translated through the inclined surfaces of the spindles 120 and 140 and bolt 20 to retract the bolt 20, so that the door may be freely opened. Actuation of either the receiving spindle or the protruding spindle causes the return springs 130 to compress since the distance between 121 and 147 (and also 141 and 127) is decreased. The slide surfaces of each of the spindles 120 and 140 are in sliding engagement with each other, and the tail ends of each spindle are aligned to operatively engage and compress the return springs 130. Once the force applied to the actuated spindle is released, however, the compressed springs cause the spindle(s) to move from their engaged position back to their neutral or disengaged position, and spring bolt 70 also acts on the bolt 20 to cause bolt 20 to return to its extended position.

In the first preferred embodiment of the push-pull latch mechanism 10 of the present invention, the latch bolt springs 70 were relied upon to bias the spindles toward their neutral position. However, applications arise where the force of the latch bolt springs 70 may not be sufficient to insure that the spindles return to their neutral or disengaged position, or situations may arise where the bolt springs 70 have such great force that they adversely affect the ability of the bolt 20 to retract with minimal force as the door is being closed. By utilizing spindle return springs 130, the spindles 100 are biased in a disengaged position without affecting the spring force applied to the latch bolt 20 by bolt springs 70. This allows the latch bolt spring force to be small, while the spindle-return spring force may be large without affecting the latch bolt spring force.

Only one of the spindles is required to be equipped with a spindle return spring 130. Although the return springs 130 and bolt springs 70 are illustrated as a compression spring, other types of springs capable of similar functionality are possible. Also, the spindle part configuration is designed for open/shut casting or injection molding. This minimizes cost for the part, and allows the spindle return spring 130 to be assembled and shipped as an assembly to ease installation. The lock of the present invention may be utilized with the spring-loaded spindles as it was for the non-spring-loaded spindles described herein. Many other methods known in the art may be employed to retain the axial alignment of the spindles during operation, including an attachment screw, and/or other forms of and combinations of protruding boss (es) and receiving slot(s).

Additional embodiments of the spindle spring arrangement of the present invention may be employed. The return springs 130 may be of smaller diameter at one end than the other end, could be configured to engage the housing or even an inward facing surface of the door, rather than a component of the other spindle. This arrangement is particularly useful in a single-spindle arrangement. The springs 130 could be carried in the housing and engage protrusions in the spindles rather than be located integrally within the spindle, as illustrated above.

Spring arrangements other than compression springs may be also be employed, with varying configurations for engagement with the latch housing, opposing spindle, or various surfaces of the door into which the latch is mounted. By way of example, the spindle springs could be of a leaf spring type, and be mounted externally of the housing, rather than internally, as shown above.

Another possible modification to the latch bolt of the present invention is to put arc or curvature in the inclined surfaces 24 of the bolt 20, the inclined surface 162 of the receiving spindle 120, and the inclined surface 166 of the protruding spindle 140. This curvature may be constant or irregular. Curvature is employed to reduce friction, reduce wear and tear, and enhance the slide capability between the bolt and the spindles for better performance, and to reduce the duty of the springs employed for the spindles and/or the bolts.

The present invention is symmetrical for use on both right and left handed doors without installer modification, and is compact enough to be used on virtually any door. Furthermore, the slide actuation method allows push-pull actuation in a mortise application. Actuation members can be oriented in many different ways to translate the spindle, allowing for virtually any type of external actuation method to be secured to the latch bolt mechanism 10, including push, pull, lift, trigger, and rotational external actuators.

The above specification and drawings provide a description of the invention relating to push-pull latch bolt mechanisms. Since many embodiments of the present invention can be made without departing from the spirit and intended scope of the invention, the invention resides in the claims hereinafter appended.

The invention claimed is:

1. A latch bolt mechanism comprising:

(a) an elongated housing defining a bolt channel for receiving a bolt and transverse spindle opening for receiving two spindles;

(b) an elongated bolt having a transverse bore extending through the bolt defining two inclined spindle bearing surfaces, the bolt being slidably mounted within the bolt channel of the housing for movement between an extended position and a retracted position;

(c) two spindles each with a leading inclined engagement surface, slidably mounted through the spindle opening of the housing and passing through the transverse bore of the bolt, the spindle being slidably mounted for movement between a disengaged position with the inclined engagement surface of a spindle operatively abutting a corresponding inclined spindle bearing surface of the bolt when the bolt is in the extended position, and an engaged position wherein the inclined engagement surface of a spindle operatively engages a corresponding inclined spindle bearing surface of the bolt to cause the bolt to move to the retracted position; and (d) a spindle bias means retained within a cavity in the surface of each spindle for biasing each spindle into its disengaged position.

2. The latch bolt mechanism of claim 1, wherein each spindle bias means comprises a compression spring mounted within said cavity formed in the spindle.

3. The latch bolt mechanism of claim 2, wherein the cavity formed in each spindle is axially aligned with each spindle.

4. The latch bolt mechanism of claim 1, wherein the bolt is actuated from the extended position to the retracted position in response to pushing each spindle from the disengaged position to the engaged position.

5. The latch bolt mechanism of claim 1, wherein the bolt is actuated from the extended position to the retracted position in response to pulling the spindle from the disengaged position to the engaged position.

6. The latch bolt mechanism of claim 1 further comprising bolt bias means for biasing the bolt into the extended position.

7. The latch bolt mechanism of claim 6, wherein the bolt bias means comprises a compression spring.

8. The latch bolt mechanism of claim 7, wherein the compression spring is positioned between an end wall of the housing and one end of the bolt for biasing the bolt in the extended position until actuated by each spindle to the retracted position.

9. The latch bolt mechanism of claim 1, wherein the inclined bearing surface of the bolt and/or spindle is non-planar.

10. The latch bolt mechanism of claim 9, wherein the non-planar inclined bearing surface of the bolt and/or spindle has constant or varying curvature.

11. A latch bolt mechanism comprising:

(a) an elongated housing defining a bolt channel for receiving a bolt and at least one transverse spindle opening;

(b) an elongated bolt having a transverse bore extending through the bolt defining two inclined spindle bearing surfaces within the bore for receiving two spindles, the bolt being slidably mounted within the bolt channel of the housing for movement between an extended position and a retracted position;

(c) two spindles moving independently of each other, each having an inclined engagement surface at a leading engagement end and a spindle bias means cavity, the spindles each being slidably mounted through the spindle openings of the housing and passing through the bore in the bolt for movement between a disengaged position with an inclined engagement surface of each spindle operatively abutting an inclined spindle bearing surface of the bolt when the bolt is in the extended position, and an engaged position wherein the inclined engagement surface of at least one of the spindles operatively engages a corresponding inclined spindle bearing surface of the bolt to cause the bolt to move to the retracted position; and (d) a spindle bias means retained within a cavity in the surface of at least one of the spindles for biasing that spindle to its disengaged position, the bolt being returned to its extended position by the spindle bias means when the external force is no longer applied to the spindle.

12. The latch bolt mechanism of claim 11, wherein the spindle bias means comprises a compression spring mounted within the cavity formed in the spindle.

13. The latch bolt mechanism of claim 12, wherein the cavity formed in the spindle is axially aligned with the spindle.

14. The latch bolt mechanism of claim 11 further comprising bolt bias means for biasing the bolt into the extended position.

15. The latch bolt mechanism of claim 14, wherein the bolt bias means is a compression spring.

16. The latch bolt mechanism of claim 15, wherein the compression spring is positioned between an end wall of the housing and one end of the bolt for biasing the bolt in the extended position until actuated by the spindle to the retracted position.

17. The latch bolt mechanism of claim 11, wherein the bolt is actuated from the extended position to the retracted position in response to pushing the spindle from the disengaged position to the engaged position.

18. The latch bolt mechanism of claim 11, wherein the bolt is actuated from the extended position to the retracted position in response to pulling the spindle from the disengaged position to the engaged position.

19. The latch bolt mechanism of claim 11, wherein the two inclined spindle bearing surfaces of the bolt face different directions.

20. The latch mechanism of claim 11, wherein the spindles are oppositely oriented with respect to each other.

21. The latch bolt mechanism of claim 11, wherein the inclined engagement surfaces of the spindles are at an angle of approximately 40 degrees from the line of travel of the bolt.

22. The latch bolt mechanism of claim 11, wherein at least one of the inclined spindle bearing surfaces of the bolt and/or the inclined engagement surface of at least one of the spindles is non-planar.

23. The latch bolt mechanism of claim 22, wherein the non-planar inclined spindle bearing surface of the bolt and/or the inclined engagement surface of at least one spindle has constant or varying curvature.

24. The latch bolt mechanism of claim 11 including means for retaining the spindles in axial alignment.

25. The latch bolt mechanism of claim 24 further including a projection carried by one spindle in cooperative engagement with and guided by a guide slot formed in the second spindle for retaining the spindles in axial alignment.

26. The latch bolt mechanism of claim 24 further including a roller pin secured through one spindle in cooperative engagement with and guided by a guide slot formed in the second spindle for retaining the spindles in axial alignment.

27. The latch bolt mechanism of claim 24 further including an attachment screw secured through one spindle in cooperative engagement with and guided by a guide slot formed in the second spindle for retaining the spindles in axial alignment.

28. The latch bolt mechanism of claim 11, further comprising a lock means for securing the bolt in its extended position.

29. The latch bolt mechanism of claim 28, wherein the lock means comprises:

(a) a lock for operatively engaging the bolt to maintain a fixed extended position when the lock means is actuated to its locked position;

(b) a lock guide within the housing for guiding the lock between a locked and unlocked position; and (c) a lock channel within the bolt for permitting movement of the bolt between the extended and retracted positions until the lock is actuated to the locked position.

30. The latch bolt mechanism of claim 29, wherein:

(a) the lock guide is transversely aligned with the line of travel of the bolt and slidably engages the lock;

(b) the lock includes placement stops and is slidably mounted to the lock guide for movement between its unlocked and locked positions; and (c) a recess in the bolt engages the placement stops of the lock upon movement of the lock to the locked position.

31. The latch bolt mechanism of claim 29, wherein:

(a) the lock guide is transversely aligned with the line of travel of the bolt and slidably engages the lock;

(b) the bolt includes a ridge configured to retain the bolt in either its locked or unlocked position; and (c) the lock includes an abutment surface for engaging the bolt ridge to maintain the lock in either the locked or unlocked position until a force is exerted on the lock to overcome the guidance provided by the ridge to move the lock between the locked and unlocked position.

32. The latch bolt mechanism of claim of 29, wherein:

(a) the lock guide is transversely aligned with the line of travel of the bolt and slidably engages the lock;

(b) the lock includes a catch peg for engaging a catch channel in the bolt to fix the position of the lock in its unlocked or locked position; and (c) the bolt includes at least one catch channel for engaging the lock catch peg.

33. The latch bolt mechanism of claim 11 further comprising:

(a) a lock means movable between a locked position and an unlocked position for securing the bolt in the extended position when the lock is in the locked position; and (b) magnetic means for magnetically moving the lock between the locked and unlocked position.

34. The latch bolt mechanism of claim 11, wherein the housing includes a spindle alignment guide and the spindle further comprises a corresponding longitudinal alignment channel for properly aligning the spindle within the housing with respect to the bolt.

* * * * *

UNITED STATES PATENT AND TRADEMARK OFFICE

CERTIFICATE OF CORRECTION

PATENT NO. : 7,607,704 B2
APPLICATION NO. : 11/043212
DATED : October 27, 2009
INVENTOR(S) : Michael W. Kondratuk It is certified that error appears in the above-identified patent and that said Letters Patent is hereby corrected as shown below:

Col. 10 claim 1, (d), line 2, the instance of "its" should be --the--.

Col. 5 claim 5, line 3, the instance of "the spindle" should be --each spindle--.

Col. 5 claim 11, (d), lines 3 and 4, each instance of "its" should be --the--.

Signed and Sealed this

Twenty-sixth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,607,704 B2
APPLICATION NO. : 11/043212
DATED : October 27, 2009
INVENTOR(S) : Michael W. Kondratuk It is certified that error appears in the above-identified patent and that said Letters Patent is hereby corrected as shown below:

Col. 11 claim 1, line 5, the instance of "its" should be --the--.

Col. 11 claim 5, line 18, the instance of "the spindle" should be --each spindle--.

Col. 11 claim 11, lines 61 and 62, each instance of "its" should be --the--.

This certificate supersedes the Certificate of Correction issued January 26, 2010.

Signed and Sealed this

Sixteenth Day of February, 2010

David J. Kappos

David J. Kappos
*Director of the United States Patent and Trademark Office*